US007059907B2

(12) United States Patent
Winings et al.

(10) Patent No.: US 7,059,907 B2
(45) Date of Patent: Jun. 13, 2006

(54) MODULAR ELECTRICAL CONNECTOR

(75) Inventors: Clifford L. Winings, Etters, PA (US); Stuart C. Stoner, Lewisberry, PA (US); Stanley W. Olson, East Berlin, PA (US); Joseph B. Shuey, Camp Hill, PA (US); Stephen B. Smith, Mechanicsburg, PA (US); James R. Volstorf, Mechanicsburg, PA (US)

(73) Assignee: FCI Americas Technology, Inc., Reno, NV (US)

( * ) Notice: Subject to any disclaimer, the term of this patent is extended or adjusted under 35 U.S.C. 154(b) by 0 days.

(21) Appl. No.: 10/626,960

(22) Filed: Jul. 24, 2003

(65) Prior Publication Data

US 2005/0020134 A1 Jan. 27, 2005

(51) Int. Cl.
*H01R 13/648* (2006.01)

(52) U.S. Cl. ..... 439/608

(58) Field of Classification Search ..... 439/608, 439/79, 76.1, 65, 701, 107, 717; 361/748
See application file for complete search history.

(56) References Cited

U.S. PATENT DOCUMENTS

| | | | | |
|---|---|---|---|---|
| 3,486,163 | A * | 12/1969 | De Vuyst et al. | 439/249 |
| 4,571,014 | A | 2/1986 | Robin et al. | |
| 4,806,107 | A | 2/1989 | Arnold et al. | 439/79 |
| 4,881,901 | A | 11/1989 | Mendenhall et al. | 439/65 |
| 5,434,362 | A * | 7/1995 | Klosowiak et al. | 361/748 |
| 5,924,899 | A | 7/1999 | Paagman | 439/701 |
| 6,083,047 | A * | 7/2000 | Paagman | 439/608 |
| 6,171,115 | B1 | 1/2001 | Mickievicz et al. | 439/76.1 |
| 6,267,604 | B1 * | 7/2001 | Mickievicz et al. | 439/79 |
| 6,544,072 | B1 * | 4/2003 | Olson | 439/608 |
| 6,641,438 | B1 * | 11/2003 | Billman | 439/608 |
| 6,663,426 | B1 * | 12/2003 | Hasircoglu et al. | 439/608 |
| 6,685,488 | B1 * | 2/2004 | Billman et al. | 439/108 |
| 6,739,918 | B1 * | 5/2004 | Cohen et al. | 439/701 |
| 6,746,278 | B1 * | 6/2004 | Nelson et al. | 439/608 |
| 6,749,468 | B1 * | 6/2004 | Avery | 439/701 |
| 6,764,349 | B1 * | 7/2004 | Provencher et al. | 439/701 |
| 6,769,935 | B1 * | 8/2004 | Stokoe et al. | 439/608 |
| 6,884,117 | B1 * | 4/2005 | Korsunsky et al. | 439/607 |
| 2003/0124910 | A1 * | 7/2003 | Nelson et al. | 439/246 |
| 2003/0129878 | A1 | 7/2003 | Hasircoglu et al. | 439/608 |
| 2004/0229509 | A1 * | 11/2004 | Consoli et al. | 439/608 |

* cited by examiner

*Primary Examiner*—Alexander Gilman
(74) *Attorney, Agent, or Firm*—Woodcock Washburn LLP

(57) ABSTRACT

A preferred embodiment of a modular electrical connector includes a plug having a printed circuit board, a contact finger positioned on a portion of the printed circuit board, and a housing for supporting and constraining the printed circuit board so that the portion of the printed circuit board extends from the housing. The printed circuit board has a flexible portion that permits the portion of the printed circuit board to translate in relation to the housing. The modular electrical connector also includes a receptacle for mating with the plug and having a first contact for electrically contacting the contact finger when the plug and the receptacle are mated, and a housing having a slot formed therein for receiving the portion of the printed circuit board when the plug and the receptacle are mated.

33 Claims, 29 Drawing Sheets

MODULAR ELECTRICAL CONNECTOR

FIELD OF THE INVENTION

The present invention relates to electrical connectors. More specifically, the invention relates to a modular electrical connector having features that make the electrical connector tolerant to misalignment between a plug and a receptacle thereof.

BACKGROUND OF THE INVENTION

Modular electrical connectors are often used to establish electrical contact between electrical as components such as backplanes, motherboards, daughter cards, etc. Modular electrical connectors used in applications of this type often comprise a plug, and a receptacle for mating with the plug. The plug and the receptacle may each comprise a plurality of printed circuit boards (PCBs) having conductive traces formed thereon. The PCBs are usually positioned in a side by side arrangement within a housing that supports and constrains the PCBs.

The conductive traces can extend between a forward edge and a lower edge of each PCB (this type of configuration produces a so-called "right-angle" plug or receptacle adapted for mounting on a surface that is substantially perpendicular to the mating plane of the plug or receptacle). A first plurality of contact pins may be coupled to each PCB proximate the lower edge thereof. The contact pins securely engage through holes formed in anther electrical, e.g., a daughter card. The contact pins thereby facilitate mounting of the plug or receptacle on the daughter card, and establish electrical contact between the plug or receptacle and the daughter card.

A second plurality of contact pins (hereinafter referred to as "mating pins") may be coupled to each PCB in the plug, proximate the forward edge thereof. Receptacle-type contacts such as contact beams may be coupled to each PCB in the receptacle, proximate the forward edge thereof. The plug and receptacle mate in a manner that causes each the mating pins to engage a respective one of the mating pins, thereby establishing electrical contact between the plug and the receptacle. The plug and receptacle can be configured to mate when the daughter cards are positioned in substantially the same orientation, i.e., when the major planes of the daughter cards are substantially parallel. Alternatively, the plug and receptacle can be configured to mate when the respective major planes of the daughter cards are substantially perpendicular.

The ability of the plug and receptacle to mate in a satisfactory manner generally requires precise alignment between plug and receptacle and, more particularly, between each of the mating pins and the corresponding contact beam. Misalignment between the plug and receptacle as the plug and receptacle are mated can result in unacceptably high insertion forces. Moreover, misalignment occurring after the plug and receptacle have been mated can cause one or more of the mating pins to lose contact with the corresponding contact beam and, in extreme cases, can result in damage to the mating pins or the contact beams.

(Misalignment between the plug and receptacle is often caused by misalignment between the daughter cards (or other electrical component), upon which the plug and receptacle are mounted. Misalignment between the daughter cards of one or more electrical devices can be caused, for example, by manufacturing and assembly tolerances, thermal expansion, physical shock and vibration, relative movement between the electrical devices, etc.)

Furthermore, the ability of modular electrical connectors to tolerate misalignment between the plug and receptacle thereof is decreasing, in general, due to ongoing demands for smaller overall connector dimensions, higher signal speeds, lower cross talk, greater numbers of modules per board, larger boards, etc. in electrical connectors.

Consequently, a need exists for a modular electrical connector able to tolerate misalignment between a plug and a receptacle thereof.

SUMMARY OF THE INVENTION

A preferred embodiment of a modular electrical connector comprises a plug comprising a printed circuit board, a contact positioned on a portion of the printed circuit board, and a housing for supporting and constraining the printed circuit board so that the portion of the printed circuit board extends from the housing. The printed circuit board has a flexible portion that permits the portion of the printed circuit board to translate in relation to the housing.

The modular electrical connector also comprises a receptacle for mating with the plug and comprising a first contact for electrically contacting the contact of the plug when the plug and the receptacle are mated, and a housing having a slot formed therein for receiving the portion of the printed circuit board when the plug and the receptacle are mated.

Another preferred embodiment of a modular electrical connector comprises a plug comprising a first housing, a first printed circuit board at least partially mounted in the first housing so that a portion of the first printed circuit board extends from the first housing in a first direction and can flex in relation to the first housing in a second direction substantially perpendicular to the first direction, and a contact mounted on the portion of the first printed circuit board.

The modular electrical connector further comprises a receptacle for mating with the plug and comprising a second printed circuit board, a contact mounted on the second printed circuit board for electrically contacting the contact of the plug when the plug and the receptacle are mated, and a second housing for substantially enclosing the contact of the receptacle. The second housing has a slot formed therein for receiving the portion of the printed circuit board and extending in a third direction substantially perpendicular to the first and second directions when the plug and the receptacle are mated.

Another preferred embodiment of a modular electrical connector comprises a plug comprising a housing and a printed circuit board mounted in the housing so that an end portion of the printed circuit board overhangs an edge of the housing the printed circuit board having a flexible portion formed therein that permits the end portion of the circuit board to deflect in relation to the housing.

The modular electrical connector also comprises a receptacle for mating with the plug and comprising a housing having a slot formed therein for receiving the end portion so that misalignment between plug and the receptacle causes the end portion to flex in response to contact between the end portion and the housing of the receptacle.

BRIEF DESCRIPTION OF THE DRAWINGS

The foregoing summary, as well as the following detailed description of a preferred embodiment, is better understood when read in conjunction with the appended drawings. For the purpose of illustrating the invention, the drawings show an embodiment that is presently preferred. The invention is not limited, however, to the specific instrumentalities disclosed in the drawings. In the drawings.

DESCRIPTION OF PREFERRED EMBODIMENTS

Figure 1:
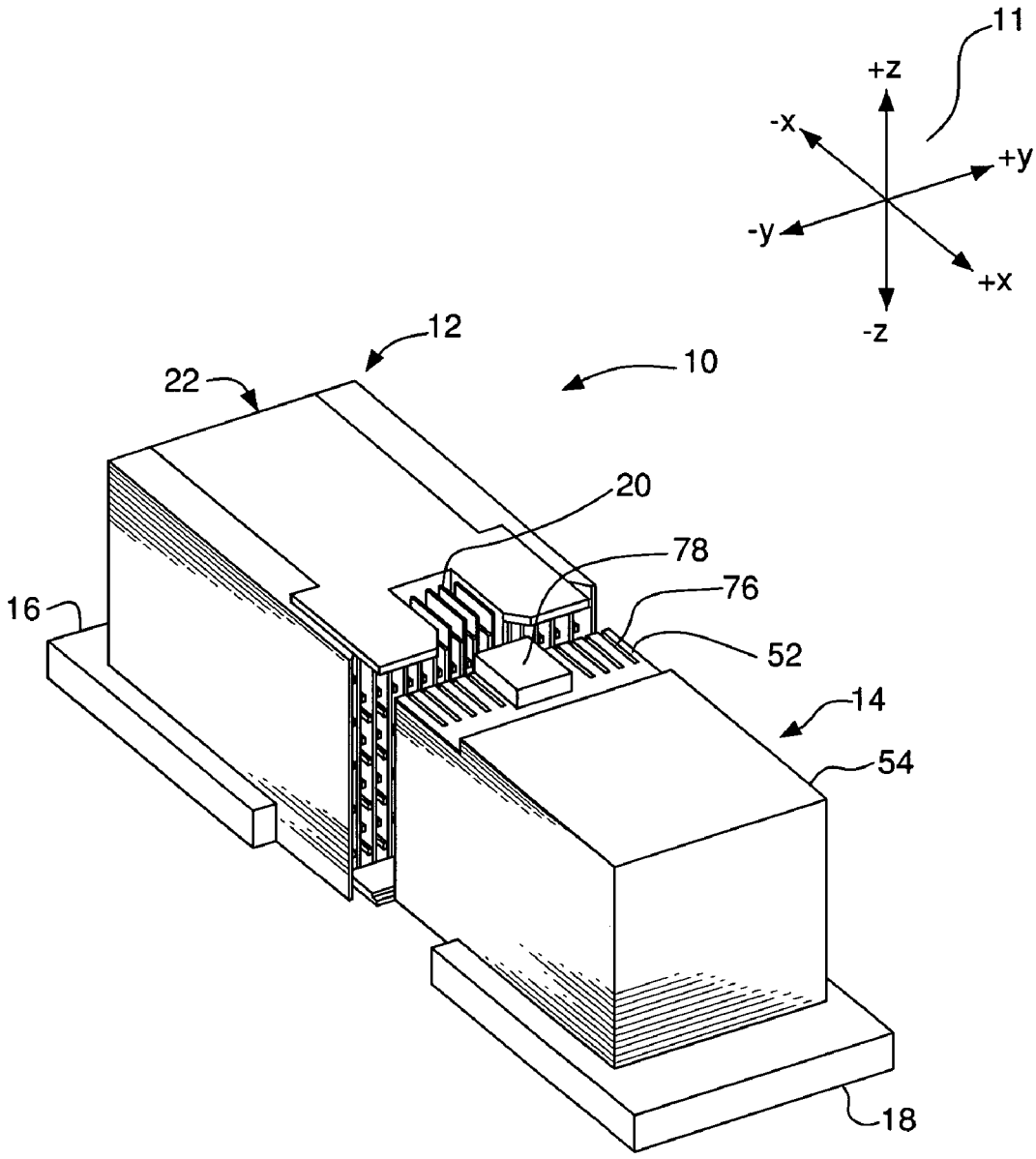
FIG. 1 is a top perspective view of a preferred embodiment of a modular electrical connector with a plug and a receptacle of the modular electrical connector in an unmated condition and mounted respectively on a first and a second daughter card.

A preferred embodiment of an electrical connector 10 is depicted in FIGS. 1–11. The figures are referenced to a common coordinate system 11 depicted therein. The electrical connector 10 comprises a plug 12 and a receptacle 14. The plug 12 can be mounted on a first daughter card 16. The receptacle 14 can be mounted on a second daughter card 18 (see FIGS. 1, 3, 5, and 11). The receptacle 14 can electrically couple the first and second daughter cards 16, 18. The plug 12 and the receptacle 14 can mate when the respective major planes of the first and second daughter cards 16, 18 are substantially perpendicular.

It should be noted that the use of the daughter cards 16, 18 is disclosed for illustrative purposes only. The plug 12 and the receptacle 14 can be mounted on other types of electrical components such as backplanes, motherboards, etc.

The plug 12 comprises a plurality of printed circuit boards ("PCBs") 20 and a housing 22 (see, e.g., FIGS. 2, 5, 7, and 8). The PCBs 20 are preferably formed by etching laminate panels to form copper conductors, and then cutting the PCBs 20 from the panels. The PCBs 20 are arranged side by side within the housing 22. Each PCB 20 can optionally be equipped with a rib 20*a* extending from an upper edge 20*b* thereof (see FIG. 4). The housing 22 can optionally be equipped with a plurality of slots 24 formed in an upper inner surface 22*a* thereof. The housing 22 securely receives the ribs 20*a* by way of the slots 24, thereby securing the PCBs 20 within the housing 22.

Figure 4A:
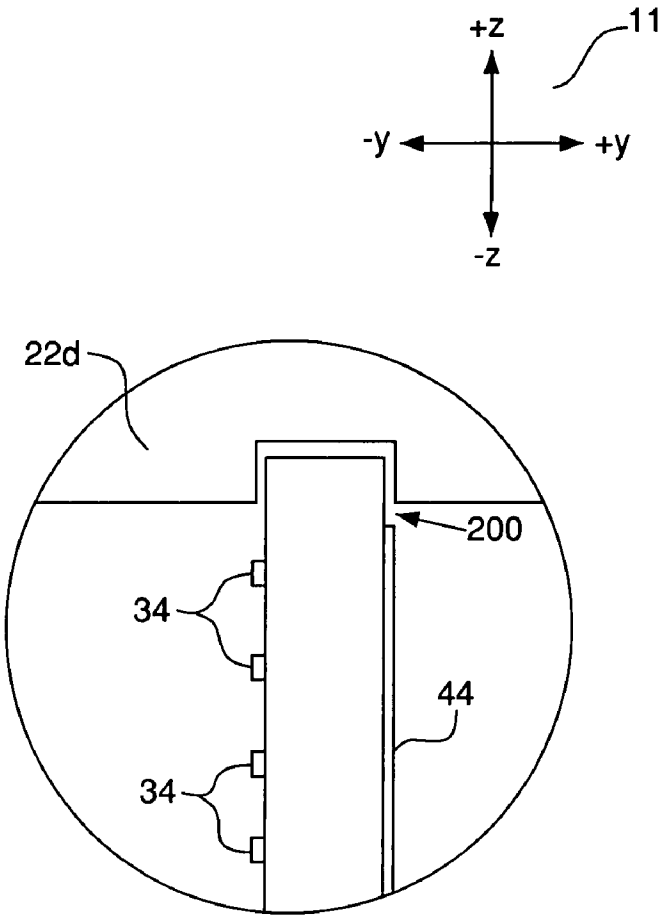
FIG. 4A is a diagrammatic view of an alternative embodiment of the printed circuit board shown in FIG. 4.

(FIG. 4A depicts an alternative embodiment of the PCB 20 in the form of a PCB 200. The PCB 200 does not include the rib 20*a*. The PCB 200 is otherwise substantially identical to the PCB 20.)

Figure 2:
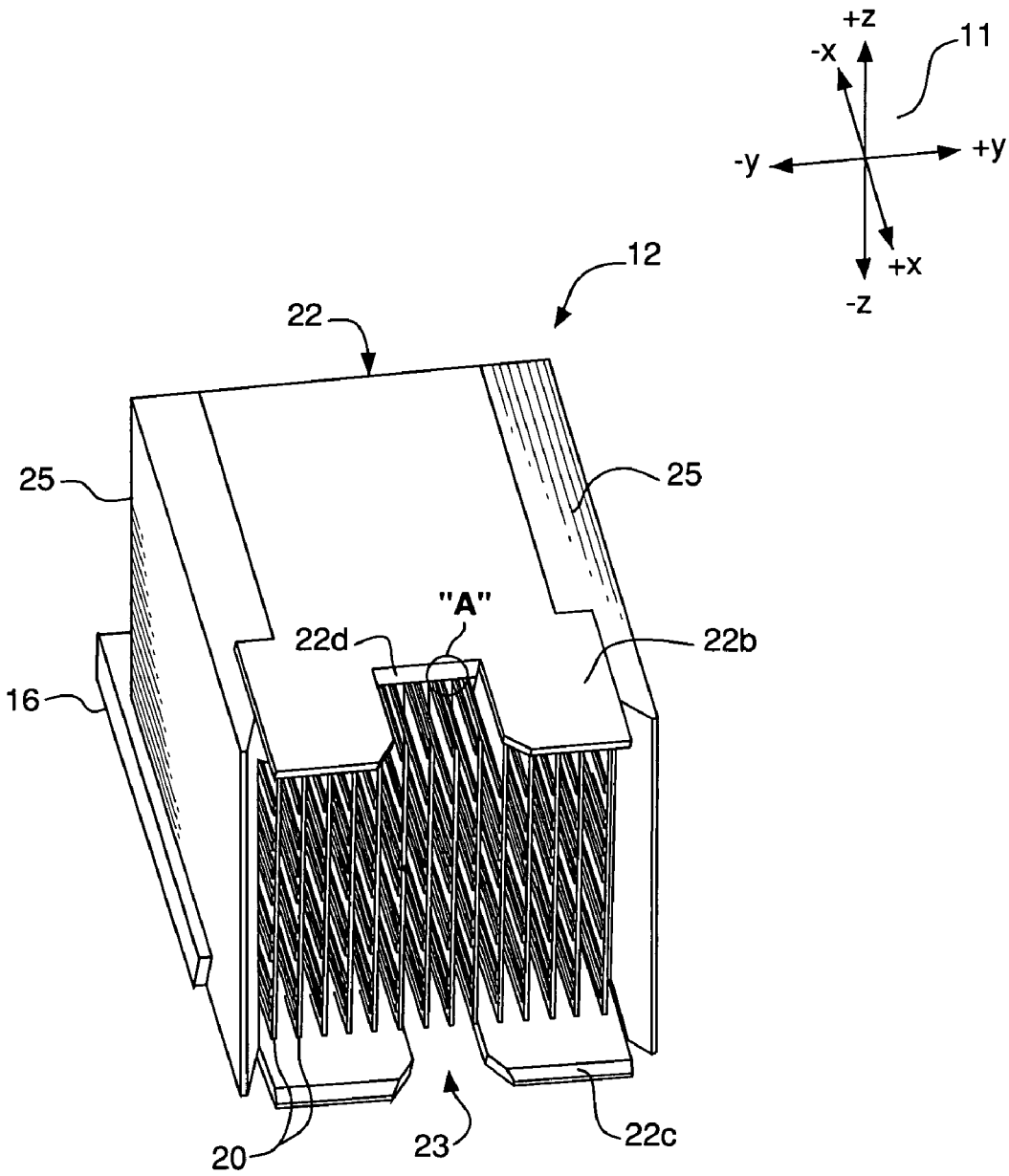
FIG. 2 is a top perspective view of the plug and the first daughter card shown in FIG. 1.
Figure 3:
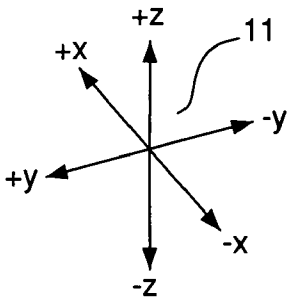
FIG. 3 is a top perspective view of the receptacle and the second daughter card shown in FIG. 1.
Figure 3:
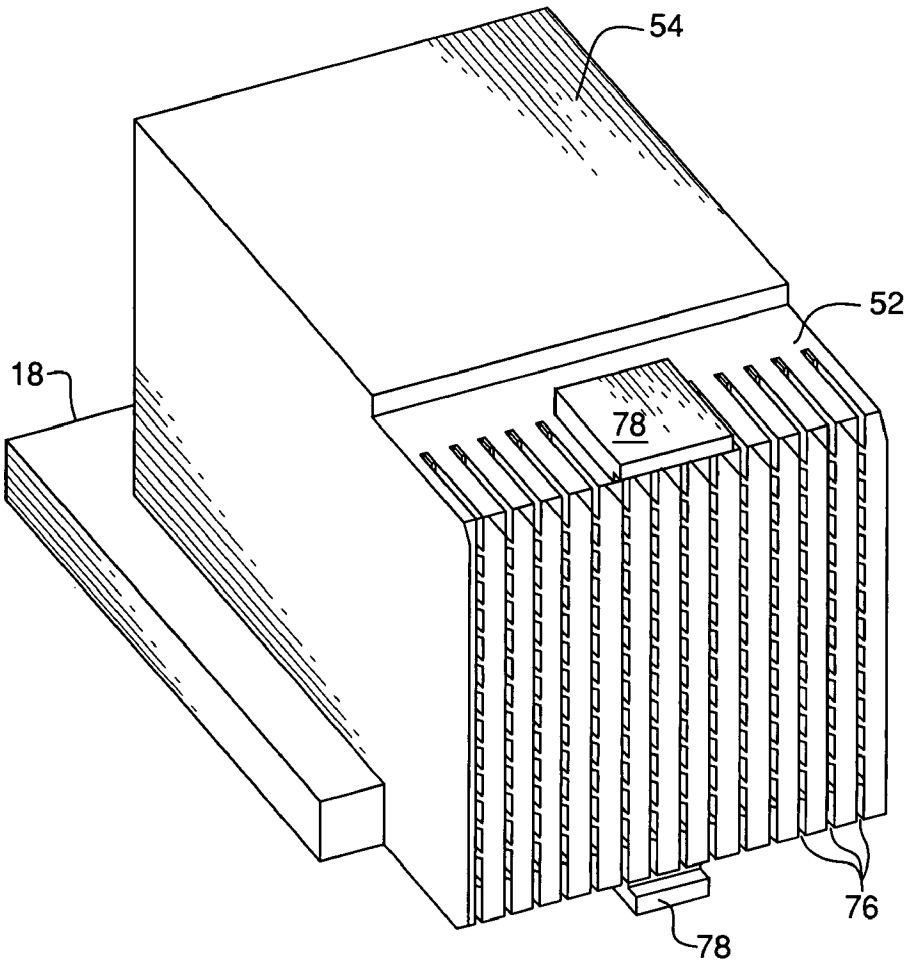
Figure 4:
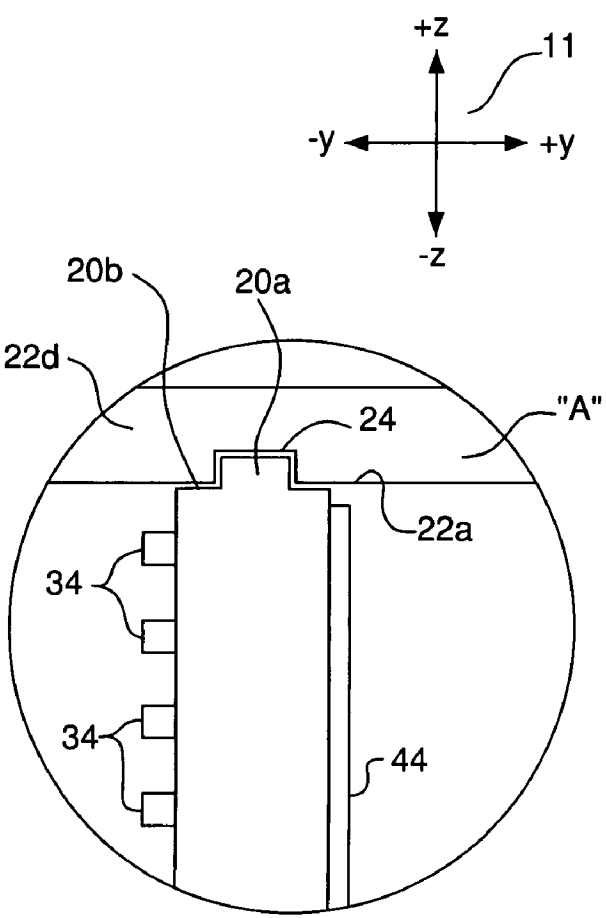
FIG. 4 is a magnified, diagrammatic view of the area designated "A" in FIG. 2, showing a printed circuit board of the plug shown in FIG. 1 and 2.

The housing 22 has an upper lip 22*b* and a lower lip 22*c* that each extend from a forward edge 22*d* thereof (see FIGS. 2 and 4). The upper lip 22*b* and the lower lip 22*c* each preferably have a slot 23 formed therein. The housing 22 can be equipped with an optional outer cover 25. The significance of these features is explained below.

Figure 6A:
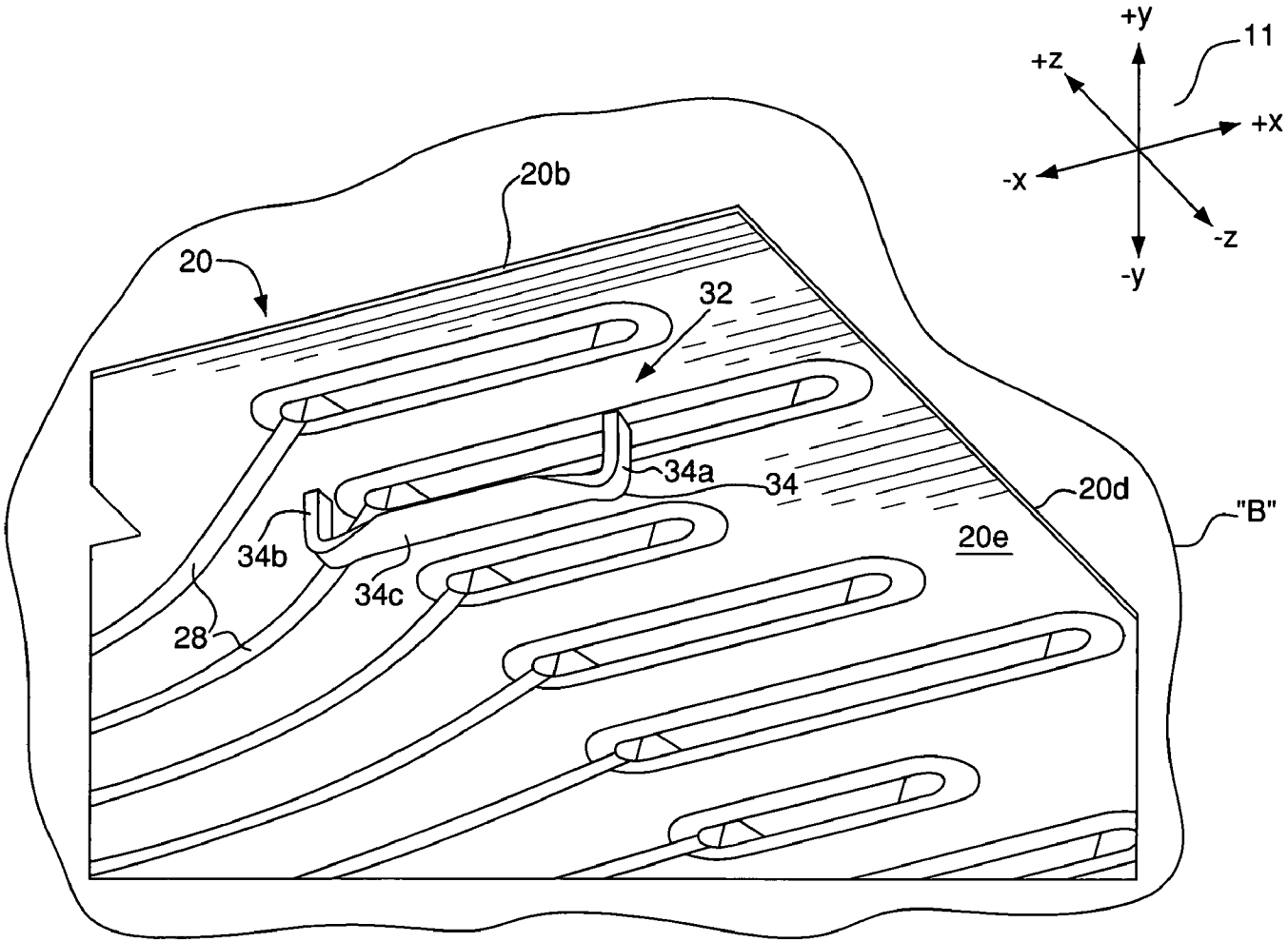
FIG. 6A is a magnified view of the area designated "B" in FIG. 5, showing a portion of a circuit board of the plug shown in FIGS. 1, 2, and 4.
Figure 6B:
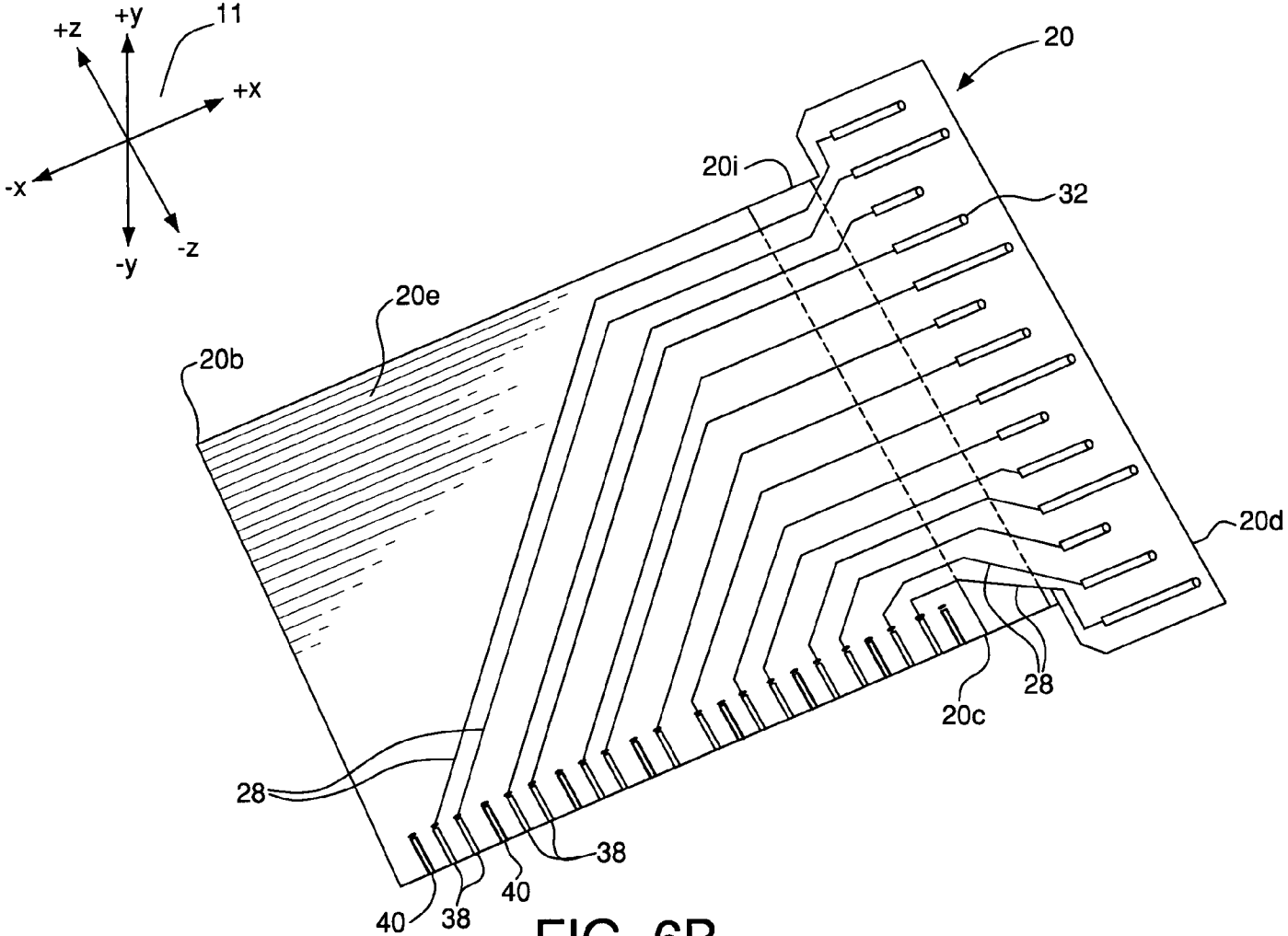
FIG. 6B is a side view the printed circuit board shown in FIG. 6A.

A forward edge 20*d* of each PCB 20 extends forward from the housing 22 when the PCBs are installed in the housing 22. Hence, the forward-most portion of each PCB 20 is freestanding, i.e., is not directly restrained by the housing 22. Moreover, each PCB 20 has a flexible region 20*i* (see FIG. 6D). The flexible region 20*i* is preferably located proximate the forward edge 22*d* of the housing 22 when the PCBs 20 are installed in the housing 22. The length ("x"-axis dimension) of the flexible region 20*i* can be, for example, approximately 6.0 mm, and the flexible region can flex laterally by, for example, approximately 0.5 mm. The flexible region 20*i* can be formed as a relatively thin region of the PCB 20, as shown in FIG. 6D.

It should be noted that directional terms such as "upper," "lower," "vertical," "horizontal," etc. are used with reference to the component orientations depicted in FIG. 1. These terms are used for illustrative purposes only, and are not intended to limit the scope of the appended claims.

Figure 5:
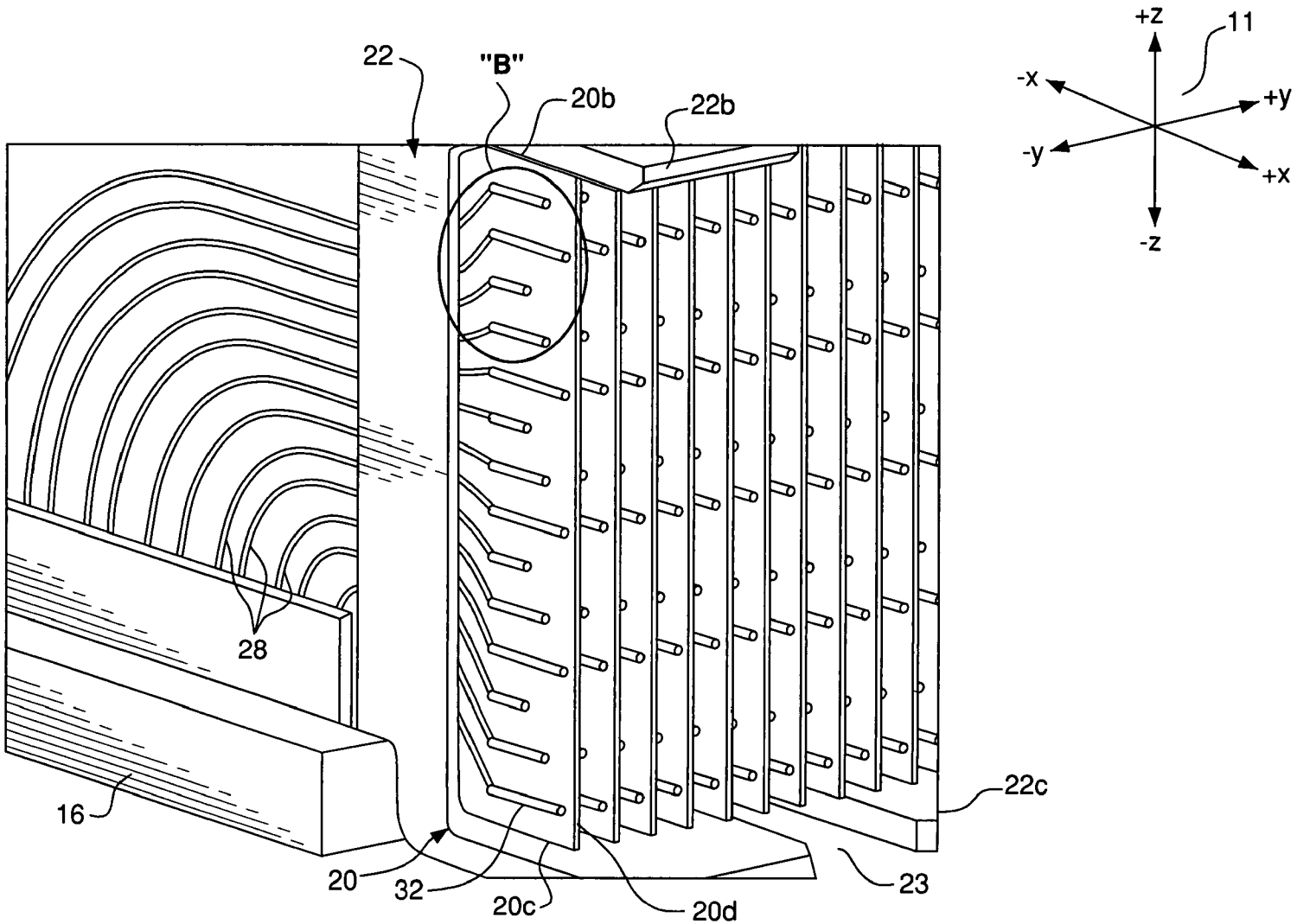
FIG. 5 is a side perspective view of the plug shown in FIGS. 1, 2, and 4, with an outer cover thereof removed, and the first daughter card shown in FIGS. 1 and 2.
Figure 6C:
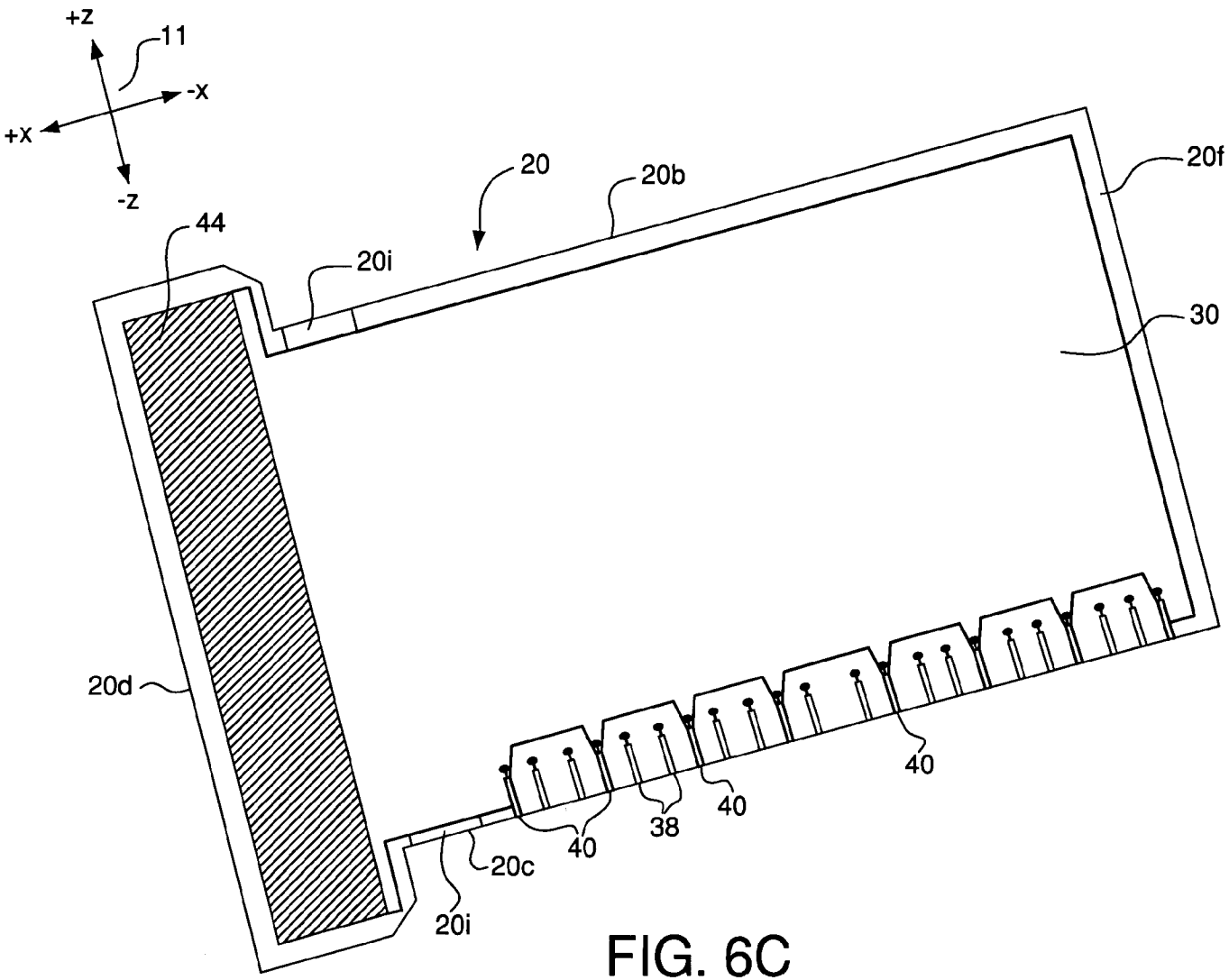
FIG. 6C is a side view of the printed circuit board shown in FIGS. 6A and 6B, from a perspective rotated 180 degrees from that of FIG. 6B.
Figure 6D:
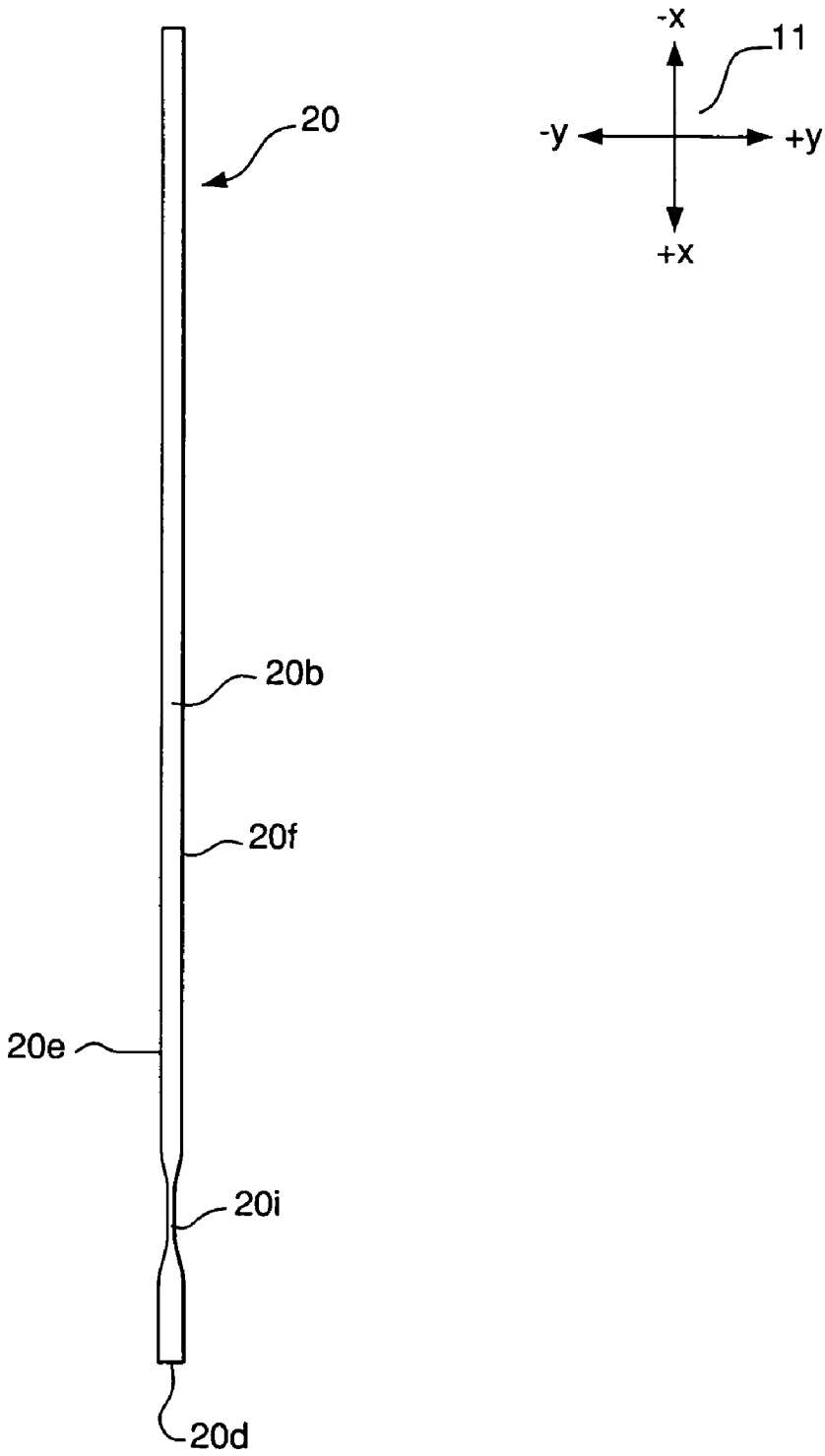
FIG. 6D is a top view of the printed circuit board shown in FIGS. 6A–6C.

Each PCB 20 has a plurality of conductive signal traces 28 formed on a first side surface 20*e* thereof (see FIGS. 5, 6A, and 6B), and a ground plane 30 formed on a second side surface 20*f* thereof (see FIG. 6C). The signal traces 28 each extend between a position proximate a lower edge 20*c* of the corresponding PCB 20, and a position proximate the forward edge 20*d* of the corresponding PCB 20. (A ground plane (not shown) can also be formed on the first side surface 20*e*, away from the signal traces 28.).

Each of signal traces 28 is electrically coupled to a corresponding set of signal pads 40. One of the signal pads 40 in each set is located on the first side surface 20*e* of the PCB 20, and the other of the signal pads 40 in each set is located on the second side surface 20*f* The signals pads 40 in each set are electrically coupled by way of a via. The signals pads 40 are each located proximate the lower edge 20*c* of the PCB 20.

The ground plane 30 is electrically coupled to ground pads 38 located on the first and second side surfaces 20*e*, 20*f* of the PCB 20, proximate the lower edge 20*c*. Each ground pad 38 located on the first side surface 20*e* is electrically coupled to a corresponding ground pad 38 located on the second side surface 20*f* by way of a via.

A plurality of contacts 32 are mounted on each PCB 20 (see FIGS. 5, 6A, and 6B). The contacts 32 are mounted on the first side surface 20*e* of each PCB 20, proximate the forward edge 20*d*. The contacts 32 each comprise a substantially U-shaped staple 34 (only one of the staples 34 is depicted in FIG. 6, for clarity). Each staple 34 includes a first and a second leg 34*a*, 34*b*, and an elongated portion 34*c* that adjoins the first and second legs 34*a*, 34*b*. The first and second legs 34*a*, 34*b* are electrically and mechanically coupled to a respective signal trace 28 by, for example, soldering. The elongated portion 34*c* of each staple 34 extends in a direction substantially perpendicular to the forward edge 20 when the staple 34 is mounted on the corresponding PCB 20.

Figure 12:
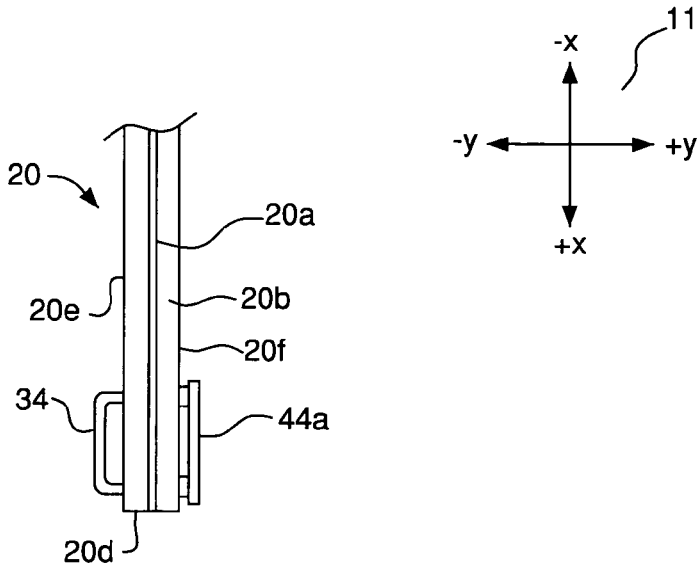
FIG. 12 is a top view of the printed circuit board shown in FIGS. 7 and 8, with a raised ground plate disposed on the printed circuit board.
Figure 13:
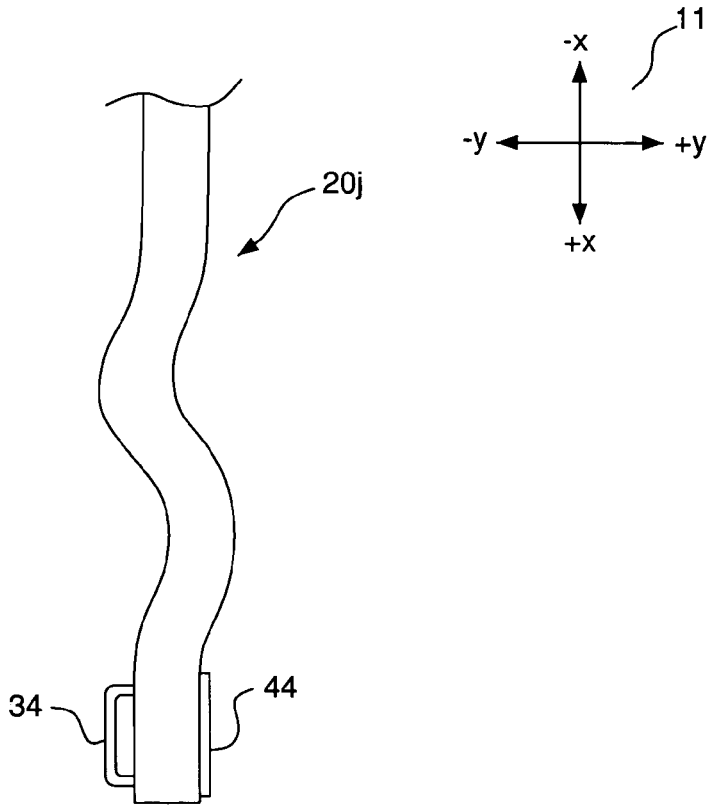
FIG. 13 is a top view of an alternative embodiment of the printed circuit board shown in FIGS. 6A–6D.

The ground plane 30 on each PCB 20 terminates in a contact region 44 formed thereon (see FIG. 6C). The contact region 44 is located on the second side surface 20*f*, proximate the forward edge 20*d*. The contact region 44 is preferably formed by gold plating on the copper ground plane. A ground plate 44*a* can be used in lieu of the solid-plated contact region 44 in alternative embodiments (see FIG. 12). The ground plate 44*a* can be raised from the second side surface 20*f* to provide the contacts 32 with the proper impedance, as shown in FIG. 12. (It should be noted that the aspect ratio of the PCB 20 is not drawn to scale in FIG. 13. In particular, the thickness ("y"-axis dimension) of the PCB 20 is exaggerated in relation to the length ("x"-axis dimension) FIG. 12.)

Figure 10:
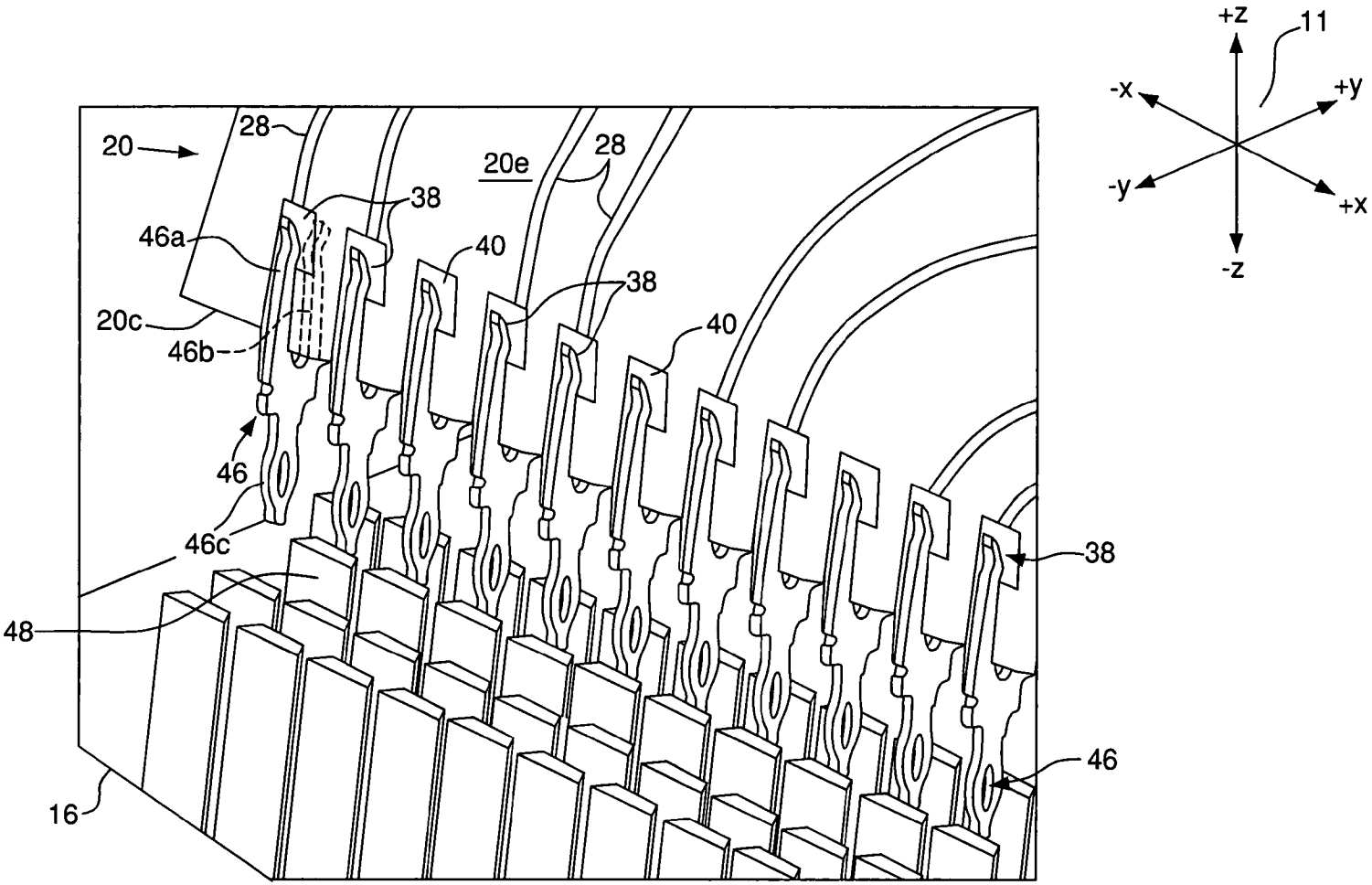
FIG. 10 is a top perspective view of the printed circuit board and a plurality of tuning-fork-type contacts of the plug shown in FIGS. 1, 2, 4, and 5 and the first daughter card shown in FIGS. 1, 2, and 5.

The plug 12 further comprises a plurality of contacts 46 (see FIG. 10). The contacts 46 electrically and mechanically couple the PCBs 20 to the daughter card 16. The contacts 46 are preferably tuning-fork-type contacts (although other types of contacts can be used in the alternative). Each contact 46 preferably comprises a first arm 46*a*, a second arm 46*b* spaced apart from the first arm 46*a*, and a pin 46*c* that adjoins the first and second arms 46*a*, 46*b*.

The contacts 46 can engage the PCBs 20 proximate the lower edges 20*c* thereof. More particularly, the arms 46*a*, 46*b* of each contact 46 are spaced apart so that insertion of a lower edge 20*c* of a PCB 20 between the arms 46*a*, 46*b* causes the arms 46*a*, 46*b* to resiliently spread apart. Continued insertion of the lower edge 20*c* into the space between the arms 46*a*, 46*b*, in combination with the resilience of the arms 46*a*, 46*b*, causes the arms 46*a*, 46*b* to securely engage the respective first and second side surfaces 20*e*, 20*f* of the PCB 20.

The pins 46*c* of each contact 46 securely engage through holes 48 in the daughter card 16 by way of a press fit, thereby securing the PCB 20 the daughter card 16 and establishing electrical contact between the PCB 20 the daughter card 16.

The plug 12 has a two-to-one ratio of signal contacts to ground contacts at the interface between the plug 12 and the daughter card 16 as shown, for example, in FIG. 10). (The plug 12 can accommodate a one-to-one ratio of signal contacts to ground contacts at the interface between the plug 12 and the receptacle 14.)

The receptacle 14 comprises plurality of printed circuit boards ("PCBs") 50, a rear housing 52, and a front housing 54 (see FIGS. 3, 7, and 8A–8C). The PCBs 50 are preferably formed by etching laminate panels to form copper conductors, and then cutting the PCBs 50 from the panels. The PCBs 50 are arranged side by side within the housing 22. Each PCB 50 can optionally have a rib 50*a* extending from an upper edge 50*b* thereof (the rib 50*a* is shown only in FIG. 8A). The rear housing 52 can optionally have a plurality of slots formed in an upper inner surface thereof. The slots securely receive the ribs 50*a*, thereby securing the PCBs 50 within the rear housing 52. (These slots are substantially identical to the slots 24 formed in the housing 22, and therefore are not depicted in the figures).

Details relating to the front housing 54 are presented below.

Figure 8A:
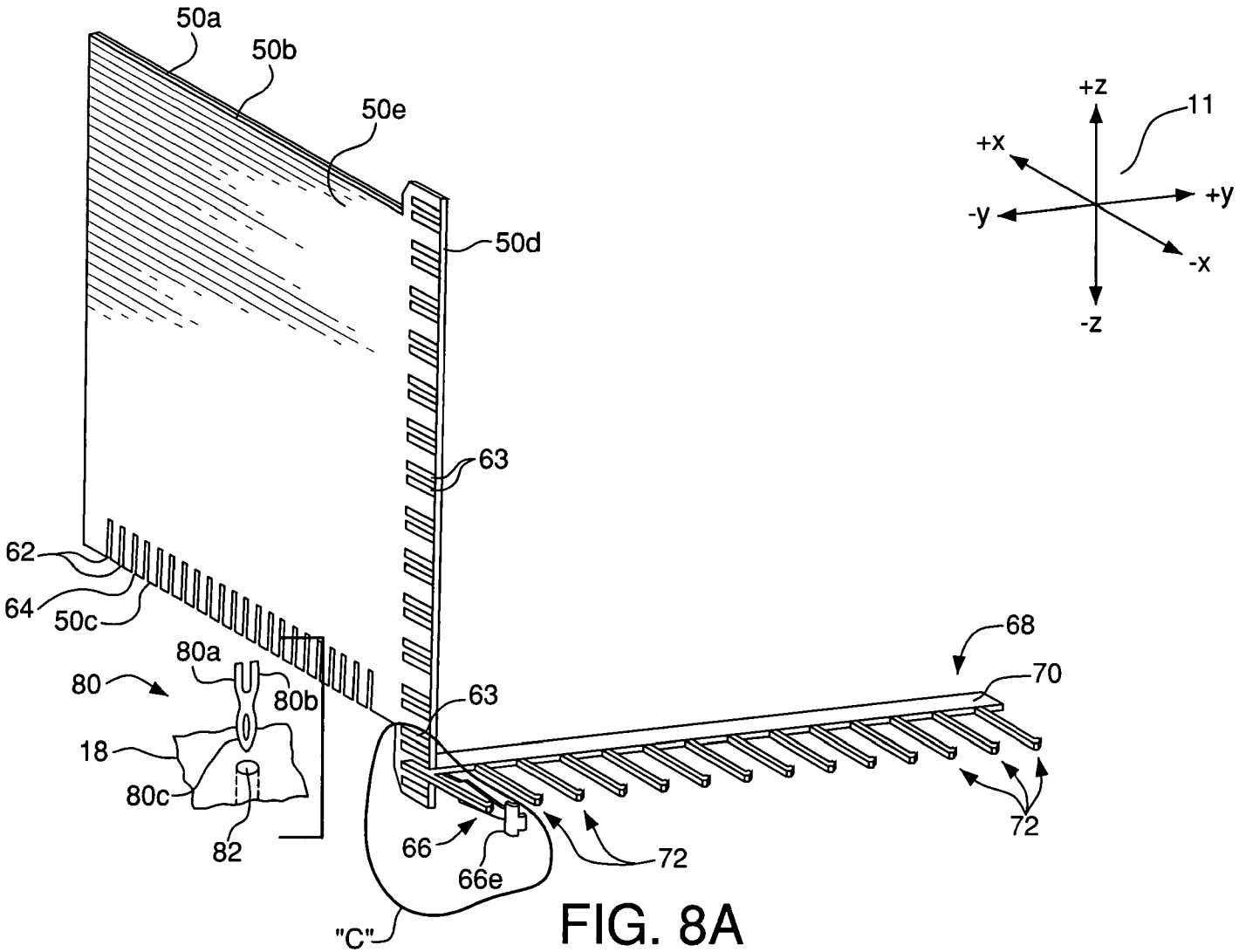
FIG. 8A is a top perspective view of one of the printed circuit boards, one of the ground combs, and one of the signal contacts shown in FIG. 7.
Figure 8B:
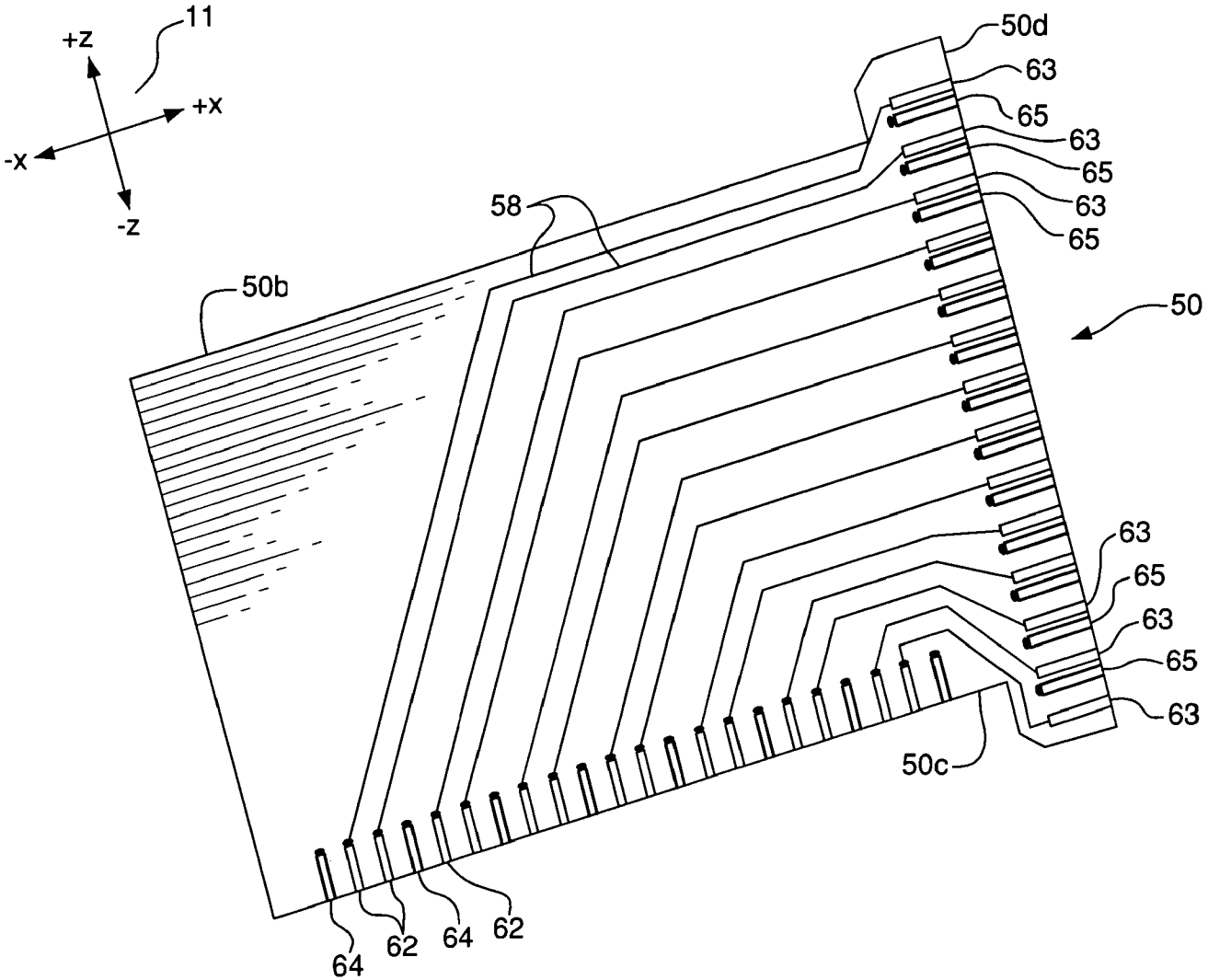
FIG. 8B is a side view the printed circuit board shown in FIG. 8A.
Figure 8C:
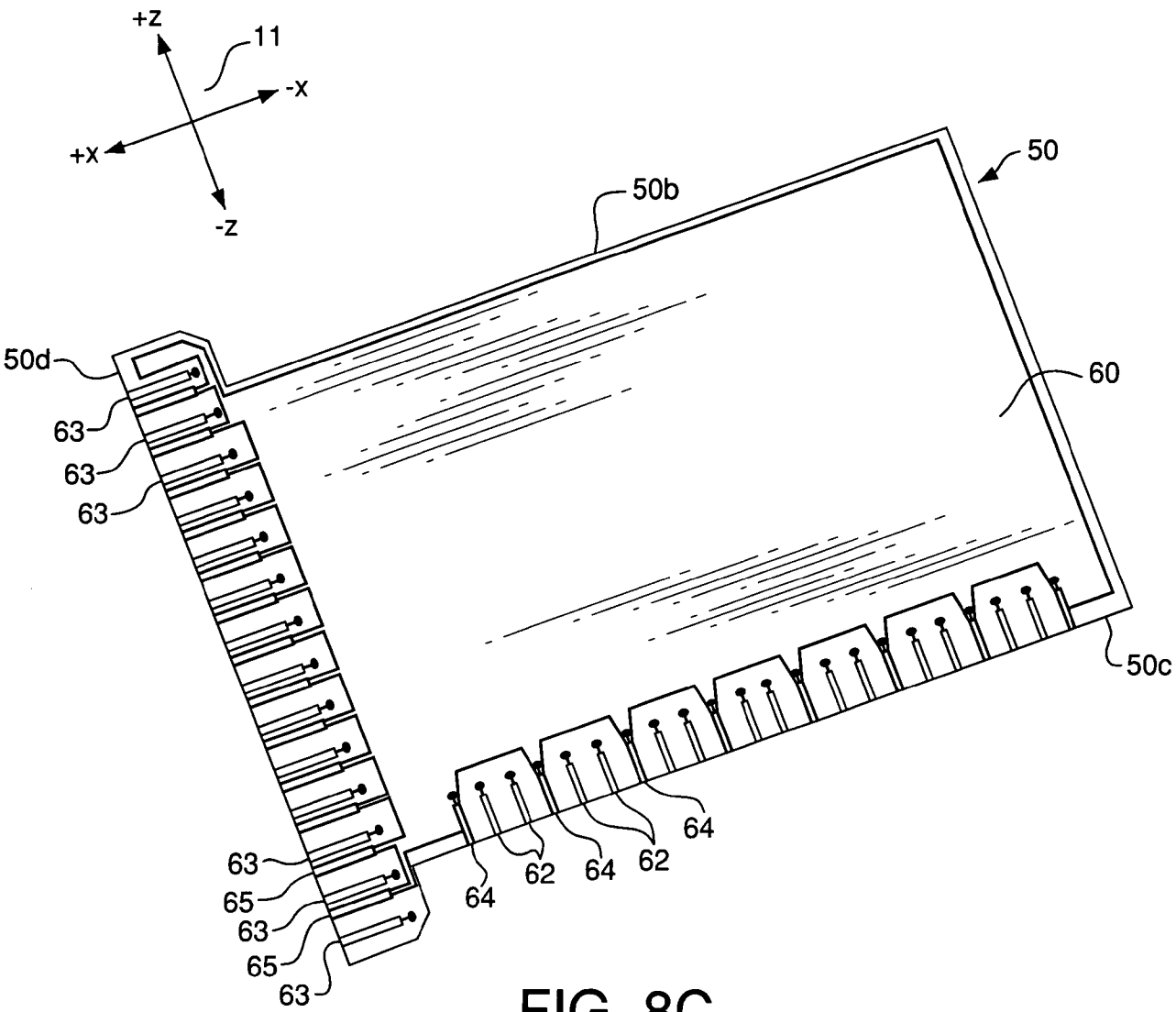
FIG. 8C is a side view of the printed circuit board shown in FIGS. 8A and 8B, from a perspective rotated 180 degrees from that of FIG. 8B.

Each PCB 50 has a plurality of conductive signal traces 58 formed on a first side surface 50*e* thereof (see FIG. 8B; the signal traces are not shown in FIG. 8A, for clarity. Each PCB 50 also includes a ground plane 60 formed on a second side surface 50*f* thereof (see FIG. 8C). The signal traces 58 each extend between a position proximate a lower edge 50*c* of the corresponding PCB 50, and a position proximate a forward edge 50*d* of the corresponding PCB 50. (A ground plane (not shown) can also be formed on the first side surface 50*e*, away from the signal traces 58.).

Each of the signal traces 58 is electrically coupled to a corresponding set of first signal pads 62. One of the first signal pads 62 in each set is located on the first side surface 50*e* of the PCB 50, and the other of the first signal pads 62 in each set is located on the second side surface 50*f*. The first signals pads 62 in each set are electrically coupled by way of a via. The first signals pads 62 are each located proximate the lower edge 50*c* of the PCB 50.

Each of the signal traces 58 is also electrically coupled to a corresponding set of second signal pads 63. One of the second signal pads 63 in each set is located on the first side surface 50*e* of the PCB 50, and the other of the second signal pads 63 in each set is located on the second side surface 50*f*. The second signals pads 63 in each set are electrically coupled by way of a via. The second signals pads 64 are each located along the lower edge 50*c* of the PCB 50.

The ground plane 60 is electrically coupled to first ground pads 64 located on the first and second side surfaces 50*e*, 50*f*, proximate the lower edge 50*c*. Each first ground pad 64 located on the first side surface 50*e* is electrically coupled to a corresponding first ground pad 64 located on the second side surface 50*f* by way of a via.

The ground plane 60 is also electrically coupled to second ground pads 65 located on the first and second side surfaces 50*e*, 50*f*, proximate the forward edge 50*d*. Each second ground pad 65 located on the first side surface 50*e* is electrically coupled to a corresponding second ground pad 65 located on the second side surface 50*f* by way of a via.

Figure 7:
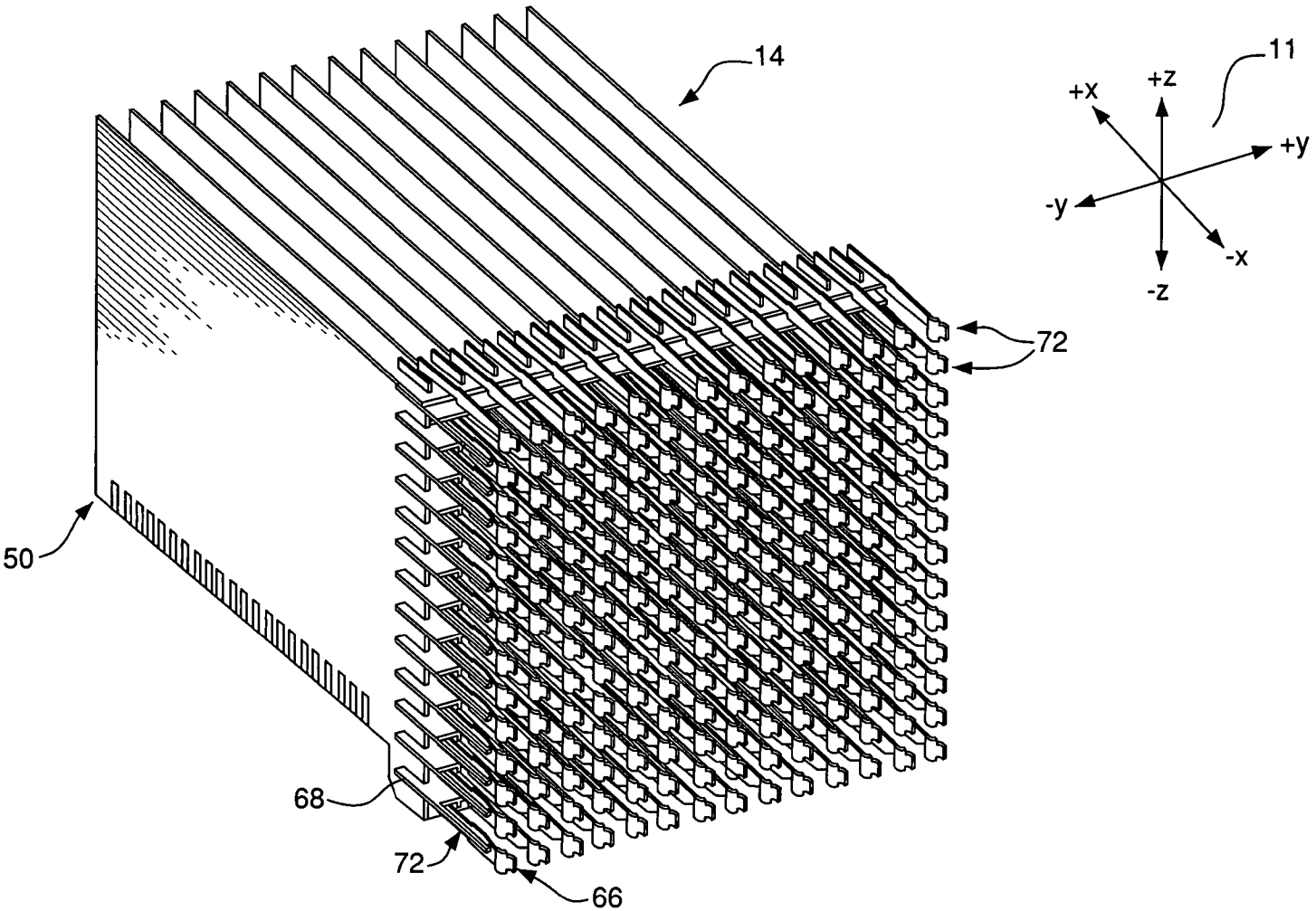
FIG. 7 is a top perspective view of the receptacle shown in FIGS. 1 and 3 with a front and rear cover of the receptacle removed and showing printed circuit boards, ground combs, and signal contacts of the receptacle.
Figure 9:
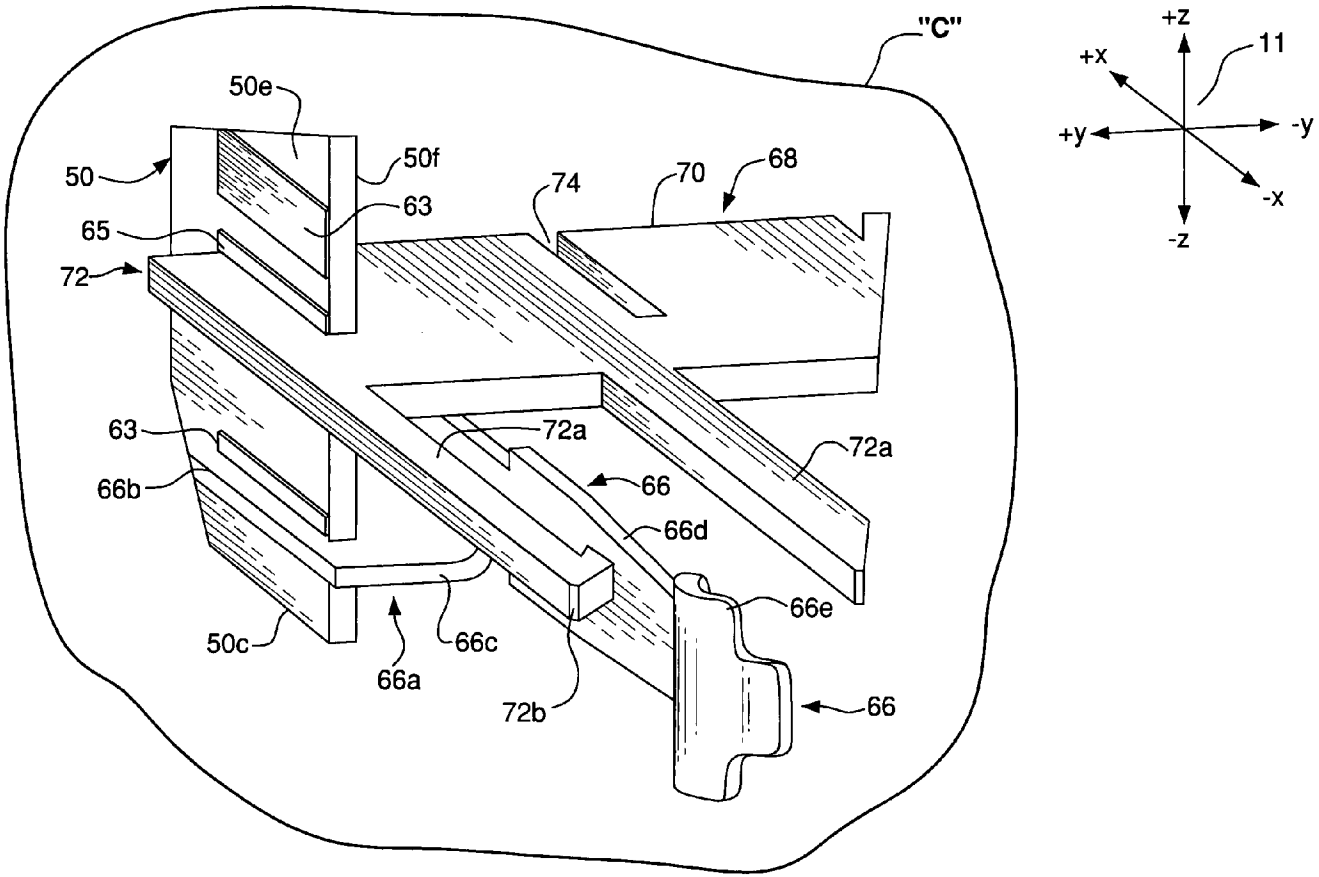
FIG. 9 is a magnified view of the area designated "C" in FIG. 8A.

A plurality of signal contacts 66 are mounted on each PCB 50, proximate the forward edge 50*d* (see FIGS. 7, 8A, and 9). Each signal contact 66 has an end portion 66*a* comprising an arm 66*b* and an angled portion 66*c*. The arm 66*b* is unitarily formed with the angled portion 66*c*, and is spaced apart from the angled portion 66*c*.

The arm 66*b* and the angled portion 66*c* engaged a corresponding PCB 50 proximate the forward edge 50*d* thereof. More particulary, the arm 66*b* and the angled portion 66*c* of each signal contact 66 are spaced apart so that insertion of the forward edge 50*d* between the arm 66*b* and the angled portion 66*c* causes the arm 66*b* to resiliently flex away from the angled portion 66*c*. Continued insertion of the forward edge 50*d* into the space between the arm 66*b* and the angled portion 66*c* to securely engage the respective sides 50*e*, 50*f* of the PCB 50. In the words, the end portion 66*a* of each signal contact 66 acts substantially as a tunning-fork-type contact.

The angled portion 66*a* and the arm 66*b* of each signal contact 66 contact a respective pair of the second signal pads 63 on the first and second side surfaces 50*e*, 50*f*, thereby establishing electrical contact between the signal contact 66 and the corresponding signal trace 58.

Each signal contact 66 also comprises an elongated beam portion 66*d* unitarily formed with and extending from the angled portion 66*c*. Each signal contact 66 further comprises a substantially rounded contact portion 66*e* unitarily formed with the beam portion 66*d*, and positioned at an end of the beam portion 66*d* opposite the angled portion 66*c*. The optimal width ("z"-axis dimension) of the contact portion 66*e* is substantially independent of the optimal width ("z"-axis dimension) of the beam portion 66*d*. In particular, the width of the beam portion 66*d* is selected based on the desired spring rate of the contact portion 66*e*. The width of the contact portion 66*e* is selected based on the desired amount of float between the plug 12 and the receptacle 14.

The receptacle 14 further comprises a plurality of ground combs 68 (see FIGS. 7, 8A, and 9. Each ground comb 68 comprises a mounting portion 70 and a plurality of ground contacts 72 unitarily formed with the mounting portion 70. Each ground contact 72 comprises a beam portion 72*a* that adjoins and extends from the mounting portion 70. Each ground contact 72 further comprises a contact portion 72*b* unitarily formed with the beam portion 72*a*, and positioned at an end of the beam portion 72*a* opposite the mounting portion 70.

A plurality of slots 74 are formed in the mounting portion 70, and extend inwardly from a rearward edge thereof. The mounting portion 70 securely engages the PCBs 50 by way of the slots 74. More particularly, each slot 74 has a width (y-axis dimension) approximately equal to or slightly smaller than a width of the PCB 50. The slots 74 each receive the forward edge 50*d* of each PCB 50. Continued insertion of the forward edge 50*d* into the slot 74, in conjunction with the resulting interference between the PCB 50 and the edges of the slot 74, cause the PCB 50 to securely engage the mounting portion 70. The mounting portion 70 is thus mounted in a substantially perpendicular orientation with respect to the PCBs 50, as shown in FIGS. 7, 8A, and 9.

The mounting portion 70 of each ground comb 68 contacts a corresponding pair of the second ground pads 65 on each PCB 50. More particularly, a first edge of each slot 74 contacts one of the ground pads 65 on the first side surface 50*e* of the PCB 50, and a second edge of the slot contacts one of the second ground pads 65 on the second side surface 50*f*. This contact establishes electrical contact between the corresponding ground plane 60 and the mounting portion 70 (as well as the ground contacts 72). The respective locations of the second ground pads 65 and the first signal pads 62 on each PCB 50 are staggered so that the mounting portion 70 contacts only the ground pads 65, and the signal contacts 66 contact only the signal pads 62.

Each ground comb 68 is positioned directly above a corresponding row of signal contacts 66 (see FIG. 7). The angled portion 66*d* of each signal contact 66 positions the contact portion 66*e* thereof proximate the contact portion 72*b* of the adjacent ground contact 72. In other words, the angled portion 66*d* causes the contact portion 66*e* to substantially face the contact portion 72*b* of the ground contact 72 that occupies the position directly above that particular signal contact 66 (see FIG. 9). The contact portion 66*e* is spaced apart from the corresponding contact portion 72*b* with respect to the lateral ("y") direction. (Thus, the ratio of signal contacts 66 to ground contacts 72 is 1:1, thereby facilitating low cross talk in the mating region of the plug 12 and the receptacle 14.)

FIG. 7 depicts the receptacle 14 without the front and rear housings 54, 52 installed, and thus shows the full array of signal contacts 66 and ground contacts 72 mated with the respective PCBs 50.

The front housing 54 substantially covers the signal contacts 66 and the ground contacts 72. The front housing 54 has a plurality of slots 76 formed therein (see FIG. 3). The slots 76 extend vertically, in the "z" direction, i.e., in a direction substantially perpendicular to the major plane of the second daughter card 18 and substantially parallel to the PCBs 50. The slots 76 facilitate access to the signal contacts 66 and the ground contacts 72, and receive the forward-most (freestanding) portion of each PCB 20, as explained below. The front housing 54 is secured to the rear housing 52 by an interference fit between the front housing 54, the rear housing 52, and the signal and ground contacts 66, 72. The front housing 54 preferably has a first and a second key 78 formed respectively on a top and bottom surface thereof. The purpose of this feature is explained below.

The receptacle 14 further comprises a plurality of contacts 80 (see FIG. 8A). The contacts 80 electrically and mechanically couple the PCBs 50 to the daughter card 18. The contacts 80 are substantially similar to the above-described contacts 46, i.e., the contacts 80 are preferably tuning-fork-type contacts (although other types of contacts can be used in the alternative). Each contact 80 preferably comprises a first arm 80*a*, a second arm 80*b* spaced apart from the first arm 80*a*, and a pin 80*c* that adjoins the first and second arms 80*a*, 80*b*.

The contacts 80 each engage a corresponding one of the PCBs 50 proximate the lower edge 50*c*. More particularly, the arms 80*a*, 80*b* of each contact 80 are spaced apart so that insertion of the lower edge 50*c* between the arms 80*a*, 80*b* causes the arms 80*a*, 80*b* to resiliently spread apart. Continued insertion of the lower edge 80*c* into the space between the arms 80*a*, 80*b*, combined with the resilience of the arms 80*a*, 80*b*, causes the arms 80*a*, 80*b* to securely engage respective sides 50*e*, 50*f* of the PCB 50.

Each of the contacts 80 contacts a corresponding pair of the first signal pads 62, or a corresponding pair of the first ground pads 64. Hence, each contact 80 acts as either a signal contact or a ground contact. The pins 80*c* of each contact 80 securely engage through holes 82 in the daughter card 18 by way of a press fit, thereby securing the PCB 50 the daughter card 18 and establishing electrical contact between the PCB 50 the daughter card 18.

The receptacle 14 has a two-to-one ratio of signal contacts to ground contacts at the interface between the receptacle 14 and the daughter card 18.

The receptacle 14 mates with the plug 12 to establish electrical contact between the daughter cards 16, 18. Mating of the plug 12 and the receptacle 14 is accomplished by substantially aligning each of the keys 78 on the front housing 54 of the receptacle 14 with a corresponding one of the slots 23 formed in the upper and lower lips 22*b*, 22*c* of the housing 22 of the plug 12 (see FIG. 1). Subsequent movement of the plug 12 toward the receptacle 14 causes the keys 78 to become disposed in the slots 23.

Movement of the plug 12 toward the receptacle 14 also causes the forward edge 20*d* of each PCB 20 in the plug 12 to become disposed in a corresponding slot 76 of the front housing 54.

It should be noted that mating the plug 12 and the receptacle 14 by moving the plug 12 toward the receptacle 14 is specified for illustrative purposes only. The plug 12 and the receptacle 14 can also be mated by moving the receptacle 14 toward the plug 12. Also, the use of the keys 78 and the slots 23 is optional, i.e., the electrical connector 10 can be configured without the keys 78 and the slots 23.

The engagement of the keys 78 and the edges of the slots 23 guides the plug 12 in relation to the receptacle 14. Continued movement of the plug 12 toward the receptacle 14 eventually causes the ground and signal contacts 66, 72 of the receptacle 14 to come into contact with the forward edge 20*d* of a corresponding one of the PCBs 20. Further movement of the plug 12 in the direction of insertion causes each signal contact 66 to contact one of the contacts 32 on the PCBs 20. More specifically, the end portion 66*c* of each signal contact 66 slidably engages the elongated portion 34*c* of a corresponding one of the staples 34. Furthermore, each ground contact 72 contacts the contact region 44 on a corresponding PCB 20. The noted contact between the contacts 32 and the signal contacts 66, and between the ground contacts 72 and the contact regions 44 establishes electrical contact between the daughter cards 16, 18.

A substantial entirety of the forward-most (freestanding) portion of each PCB 20 is disposed within a corresponding slot 76 when the plug 12 and the receptacle 14 have been fully mated. The significance of this feature is discussed below.

Figure 11:
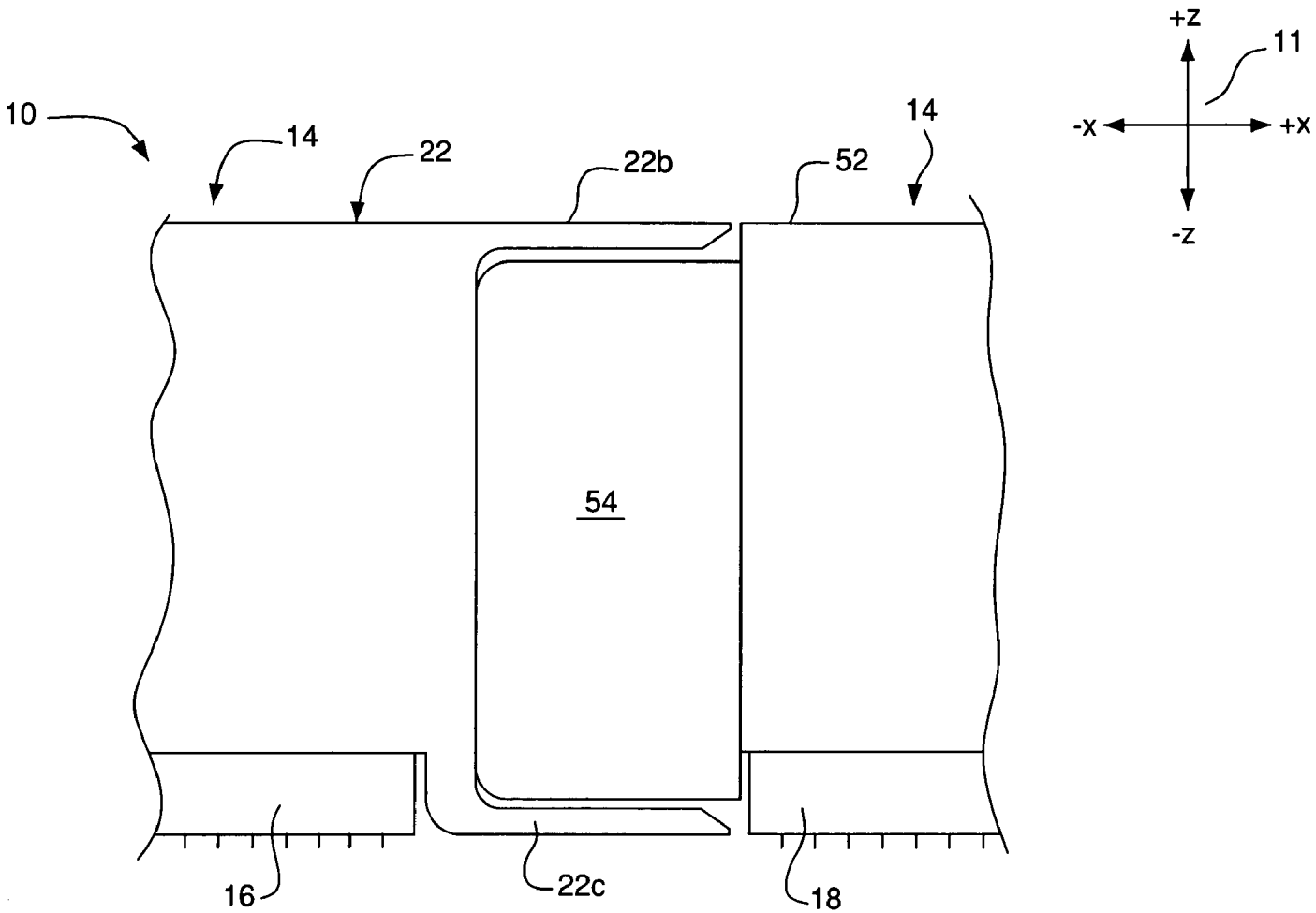
FIG. 11 is a side view of the modular electrical connector shown in FIG. 1, showing the plug and the receptacle in a mated condition, and showing the plug with an outer cover of the plug removed.

The upper lip 22*b* and the lower lip 22*c* of the housing 22 are positioned above and below the front housing 54, respectively, when the plug 12 and the receptacle 14 are meter, as depicted in FIG. 11. A clearance of approximately 0.5 mm exists between the upper lip 22*b* and the top of the front housing 54. A clearance of approximately 0.5 mm also exists between the lower lip 22*c* and the bottom of the front housing 54 when the plug 12 and the receptacle 14 are substantially aligned. The significance of this feature is explained below. (It should be noted that the optimal values for the noted clearances will vary by application, and specific values are provided for exemplary purposes only.)

The plug 12 is capable of a predetermined amount of movement, or "float," in relation to the receptacle 14 after the plug 12 and the receptacle 14 are mated. The feature allows the electrical connector 10 to tolerate a certain amount of misalignment between the daughter cards 16, 18, as explained below.

Float between the plug 12 and the receptacle 14 in the lateral ("y") direction is achieved by virtue of the flexibility of the PCBs 20. More particularly, the flexible region 20*i* of each of the PCBs 20 can deflect in response to lateral misalignment between the plug 12 and the receptacle 14. In other words, the flexibility of the flexible region 20*i* permits the freestanding portion of each PCB 20, i.e., the portion of the PCB 20 positioned within the corresponding slot 76 in the front housing 54, to deflect laterally when urged in that direction by the front housing 54. This feature permits the contacts 32 and the contact regions 44 on the PCBs 20 to establish contact, and to remain in contact with the corresponding signal contacts 66 and ground contacts 72 on the PCBs 50 when the plug 12 and the receptacle 14 are misaligned.

The PCBs 20 of alternative embodiments may be configured so that the forward-most portion thereof is thinner than a remainder of the PCB 20, thereby providing the forward-most portion with greater flexibility and enhancing the ability of the forward-most portion to flex in response to misalignment between the plug 12 and the receptacle 14. The forward-most portion of each PCB 20 can also be contoured, e.g., wave-shaped, to achieve this effect (see the alternative embodiment of the PCB 20 designated 20*i* in FIG. 13). Moreover, coplanar striplines can be substituted for the portions of the signal traces and ground planes 60 on the forward-most portion of each PCB 20 to reduce the potential for fatigue-induced failures in the signal and ground traces 58, 60 caused by repeated flexing. (It should be noted that the aspect ratio of the PCB 20*j* is not drawn to scale in FIG. 13. In particular, the thickness ("y"-axis dimension) of the PCB 20*j* is exaggerated in relation to the length ("x"-axis dimension) in FIG. 13.)

Float between the plug 12 and the receptacle 14 in the vertical ("z") direction is achieved as follows. A clearance of approximately 0.5 mm exists between the upper lip 22*b* of the housing 22 and the top of the front housing 54, and between the lower lip 22*c* of the housing 22 and the bottom of the front housing 54 when the plug 12 and the receptacle 14 are substantially aligned, as noted above (see FIG. 11).

This clearance permits the housing 22 and the front housing 22 to properly mate when misaligned by as much as approximately 0.5 mm. (The optimal values for the noted clearances, as stated above, will vary by application, and specific values are provided for exemplary purposes only.)

Moreover, each signal contact 66 of the receptacle 14 has a relatively wide end portion 66*e* (with respect to the vertical, or "y" direction), as previously noted. This feature permits the signal contact 66 to move vertically in relation to the corresponding contact 32 of the plug 12, within a predetermined range, without losing contact with the contact 32. In effect, the width of the end portion 66*e* provides the signal contact 66 with wipe in the vertical direction, thereby allowing the end portion 66*e* to establish contact, or to remain in contact with the contact 32 when the plug 12 and the receptacle 14 are misaligned. Moreover, the use of the relatively wide end portion 66*e*, in conjunction with the relatively narrow elongated portion 66*d*, gives the signal contact 66 sufficient width to remain in contact with the contact 32 while keeping the impedance of the signal contact 66 from becoming excessive.

Hence, Applicants have provided the plug 12 and the receptacle 14 with tolerance to a predetermined range of vertical misalignment by providing clearance between the housing 22 and the forward housing 54, and by configuring the signal contacts 66 in a manner that causes the signal contacts 66 to remain in contact with the corresponding contacts 32 when such misalignment is present.

It is to be understood that even though numerous characteristics and advantages of the present invention have been set forth in the foregoing description, the disclosure is illustrative only and changes can be made in detail within the principles of the invention to the full extent indicated by the broad general meaning of the terms in which the appended claims are expressed.

For example, the PCBs 20, 50 can be formed in shapes other than the rectangular shapes disclosed herein. Moreover, the corners of the PCBs 20, 50 that do not accommodate the signal traces 28, 58 and ground planes 60 can be rounded or clipped to reduce the amount of material needed to manufacture the PCBs 20, 50.

Moreover, the contacts 46, 80 can be slidably coupled to the respective PCBs 20, 50 in alternative embodiments. This arrangement can facilitate movement of the contacts 46, 80 (and the plug 12 and receptacle 14) in relation to the respective first and second daughter cards 16. 18. The sliding connections can be achieved by coating the contacting portions of the PCBs 20, 80 and the respective contacts 46, 50 with gold (rather than tin-lead), and by relaxing the normal (clamping) force between the PCBs 20, 50 and the respective contacts 46, 80 from approximately 2–3 N to approximately 0.5 N.

Furthermore, the contact fingers 32 on the PCBs 20 can be formed without the staples 34. The use of the staples 34 is preferred because the geometric configuration of the staples 34 permits the use of a relatively thin PCB 20, while maintaining sufficient impedance in the contact finger 32. The contact fingers 32 can be formed, in the alternative, from a round wire or a stamped conductor that is surface soldered and crimped to the corresponding PCB 20.

An alternative type of contact finger can also be formed using thick-film techniques. More particularly, dielectric material can be screened through a graduated mask to build up a rounded contact region, which is then metalized. Another alternative type of contact finger can be formed by molding a raised area into the PCB 20 when the PCB 20 is formed, and then metalizing the raise area.

Figure 14:
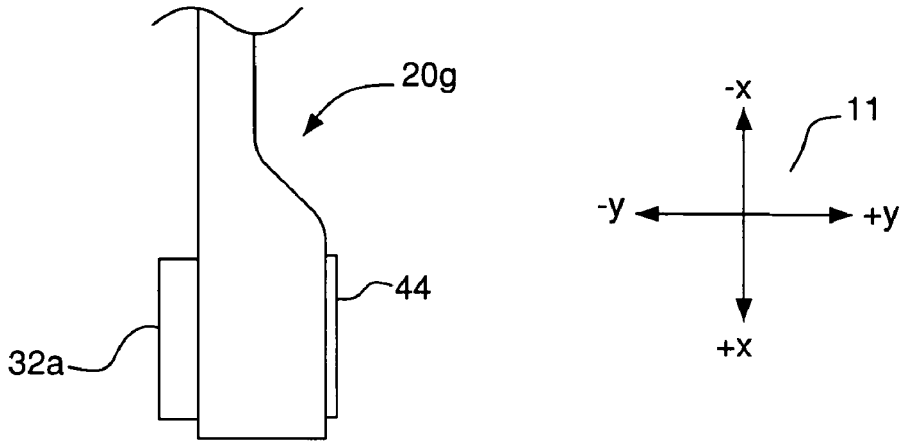
FIG. 14 is a top view of another alternative embodiment of the printed circuit board shown in FIGS. 6A–6D.

FIG. 14 depicts an alternative contact finger 32*a*. The contact finger 32*a* is relatively long, to achieve the desired wipe and sequencing, and relatively wide, to facilitate float in the vertical direction. The impedance of the contact finger 32*a* can be made sufficiently high by thickening an alternative embodiment of the PCB 20 (designated the 20*g* in FIG. 143) in the region directly below the contact finger 32*a*. The PCB 20 can be thickened using multi-layer-broad laminations, wherein cutouts are formed in the outer layers in the flexible region 20*i* to provide the requisite flexibility. Alternatively, the required impedance can be achieved by using a ground plate in lieu of the plated contact region 44, and separating from the contact fingers 32 by a sufficient distance to achieve the required impedance. The ground plane can be a shallow can supported on two or four of its sides, or a rolled piece that is surface soldered to the first side surface 20*e* of the corresponding PCB 20.

Figure 15:
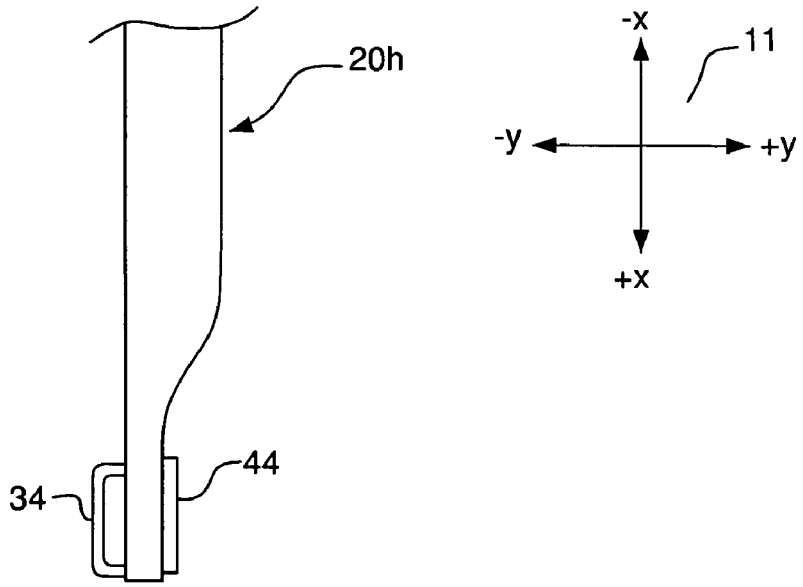
FIG. 15 is a top view of another alternative embodiment of the printed circuit board shown in FIGS. 6A–6D.

Moreover, an alternative embodiment of the PCB 20 (designated 20*h* in FIG. 15) can be made relatively thin in its forward-most portion, i.e., in the portion of the PCB 20*h* in which flexing is required. Each PCB 20*h* can also be made relatively thin in areas over which the signal and ground traces 28, 30 and the contact fingers 32 are positioned (to maintain the proper impedance therein). The remainder of each PCB 20 can thus be made relatively thick. Increasing the thickness of a molded printed circuit board, in general, improves the manufacturability of the printed circuit board, and can make it easier to mate the printed circuit board with the housing 22. (This feature can also be incorporated into the PCBs 50)

Figure 22B:
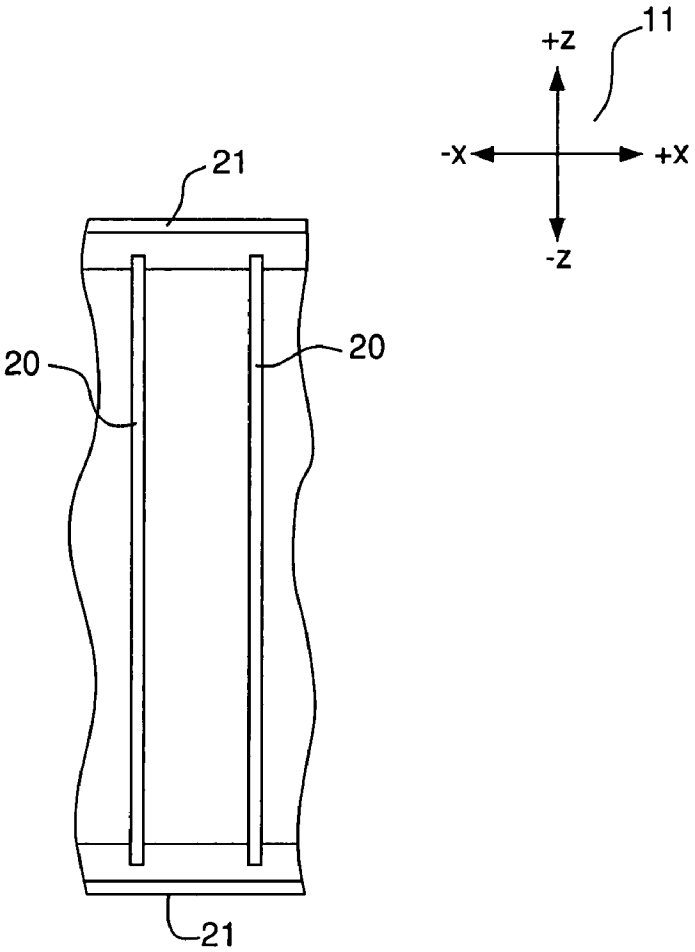
FIG. 22B is a front view of the plug shown in FIGS. 1, 2, 4, 5, and 22A, equipped with the plate shown in FIG. 22A.
Figure 22A:
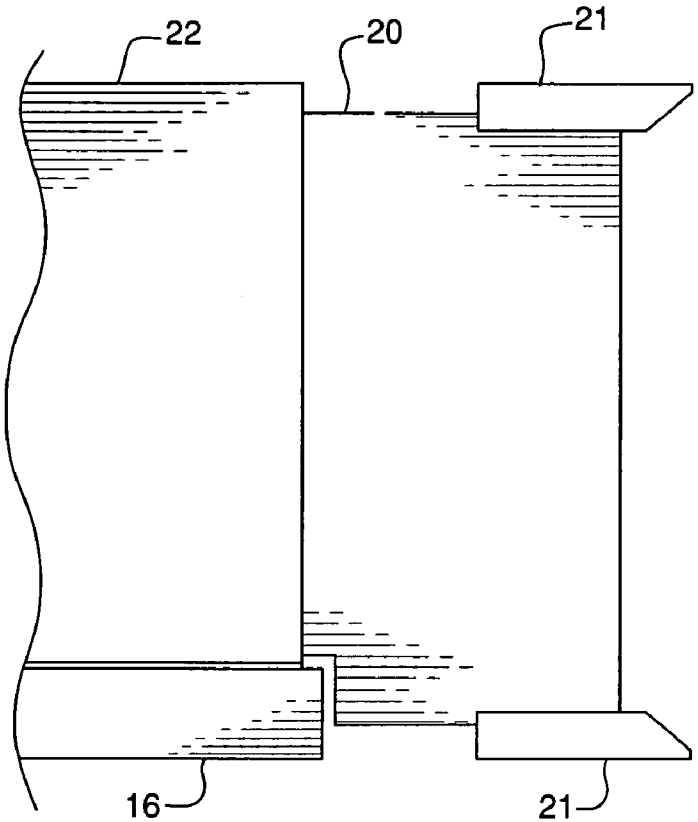
FIG. 22A is a side view of a portion of the plug and daughter card shown in FIGS. 1, 2, 4, and 5, wherein the plug is equipped with an optional plate for interconnecting the printed circuit board thereof.

The forward-most, i.e., freestanding, portions of the PCBs 20 can be mechanically coupled (see FIGS. 22A and 22B). More particularly, upper and lower plates 21 can be secured to the respective upper and lower edges 20*b*, 20*c* of the PCBs 20, proximate the forward edges 20*d*. The upper and lower plates 21 can be secured to the PCBs 20 using a suitable means such as adhesive. The upper and lower plates 21 can constrain the forward-most portions of the PCBs 20 in relation to each other, while permitting the forward-most portions of the PCBs 20 to flex in relation to the housing 22. The extra rigidity and support provided by the upper and lower plates 21 is believed to increase the overall durability and strength of the forward-most portions of the PCBs 20. Moreover, the upper and lower plates 21 can be used to guide the PCBs 20 into contact with the receptacle 14, and can thus reduce the tolerance build-up between the PCBs 20 and the receptacle 14.

Figure 26B:
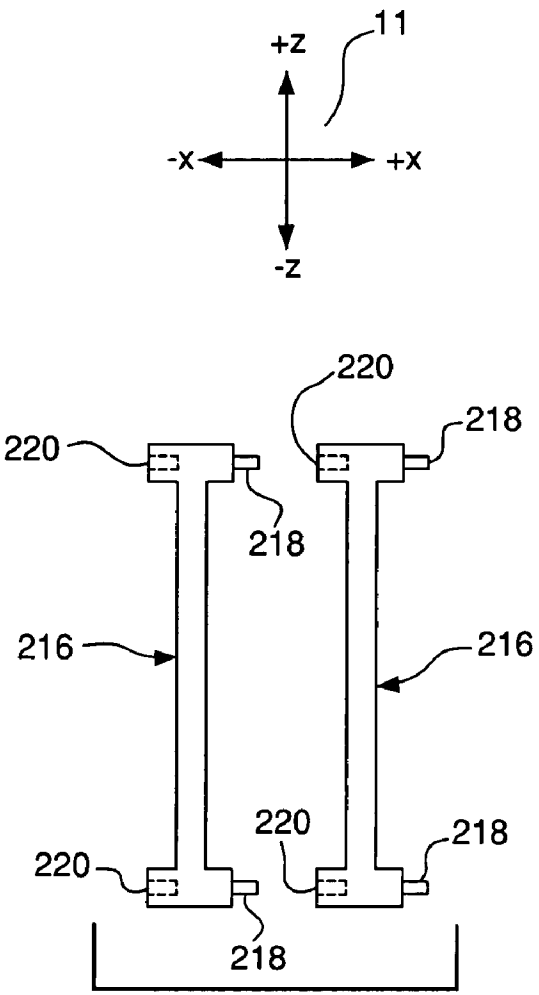
FIG. 26B is a front view of two of the PCBs shown in FIG. 25A, in an un-mated condition.
Figure 26A:
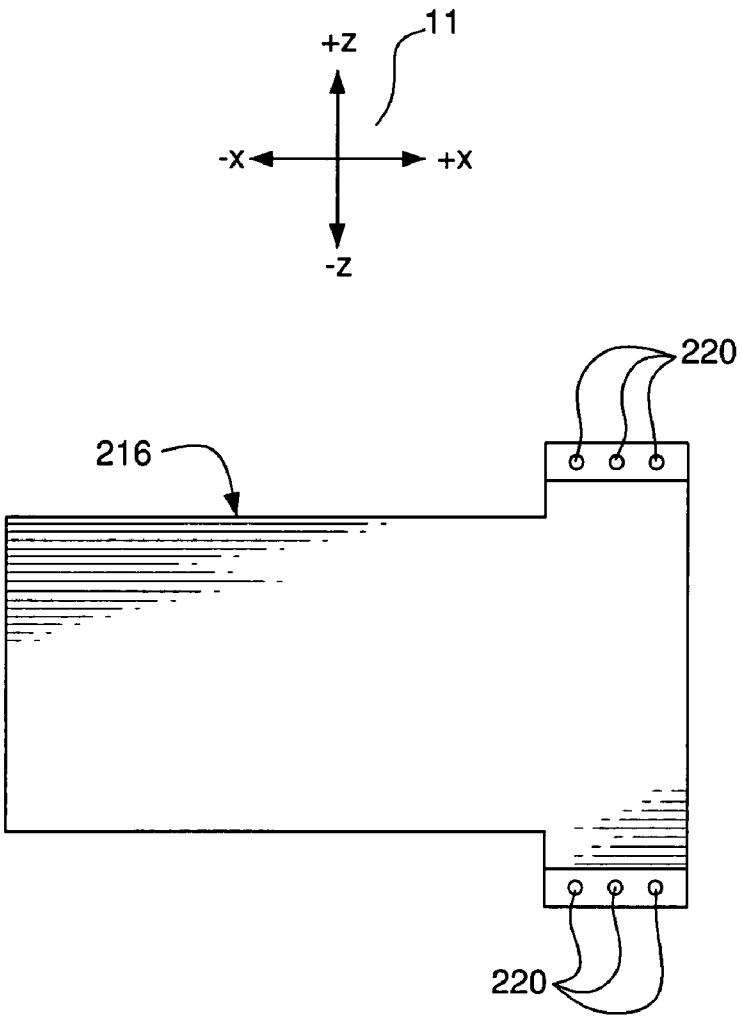
FIG. 26A is a diagrammatic side view of a portion of another alternative embodiment of the printed circuit board shown in FIGS. 6A–6D.

FIGS. 26A and 26B depict an alternative embodiment of the PCBs 20 in the form of a PCB 216. The PCB 216 has projections 218 and receptacles 220 formed thereon. The projections 218 and receptacles 220 can mate with respective receptacles 220 and projections 218 of adjacent ones of the PCBs 216 to restrain the forward-most portions of the PCBs 216 in relation to each other.

Figure 16:
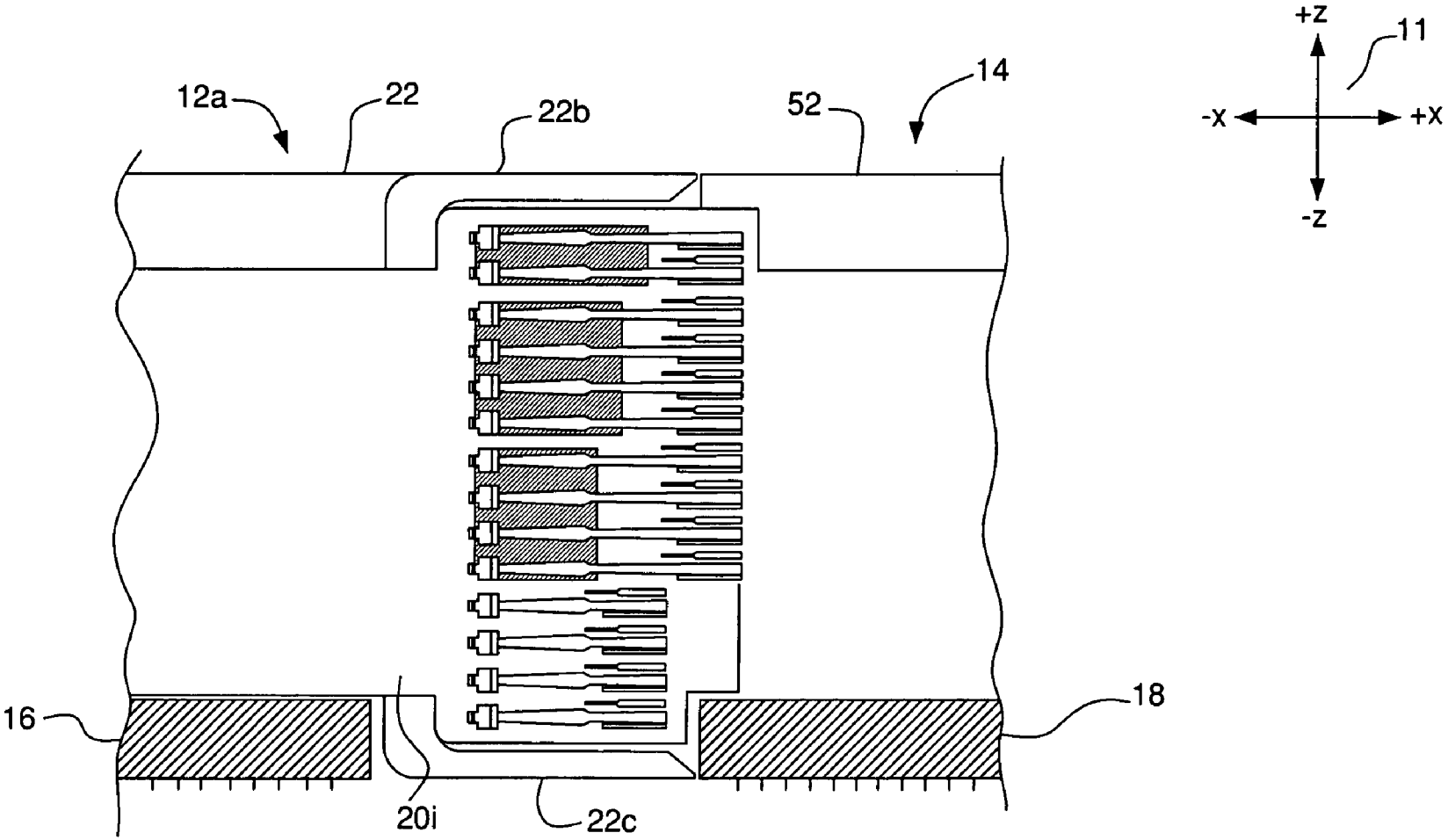
FIG. 16 is a side view of the modular electrical connector shown in FIG. 1 and comprising another alternative embodiment of the printed circuit board shown in FIGS. 6A–6D, and showing the plug with an outer cover of the plug removed.

The forward edge 20*d* of each PCB 20 can be stepped, as depicted in FIG. 16. More particularly, the portion of the forward edge 20*d* located above, i.e., at a higher elevation than, the daughter card 16 can be extended forward (in the "+x" direction). This feature facilitates sequencing, or additional levels of sequencing, of the contact fingers 32 as the plug 12 and the receptacle 14 are mated. The depth of the slots 76 on the front housing 54 that correspond to the longer (extended) portion of each PCB 20 must be increased to accommodate the increased length of the PCBs 20.

Figure 23:
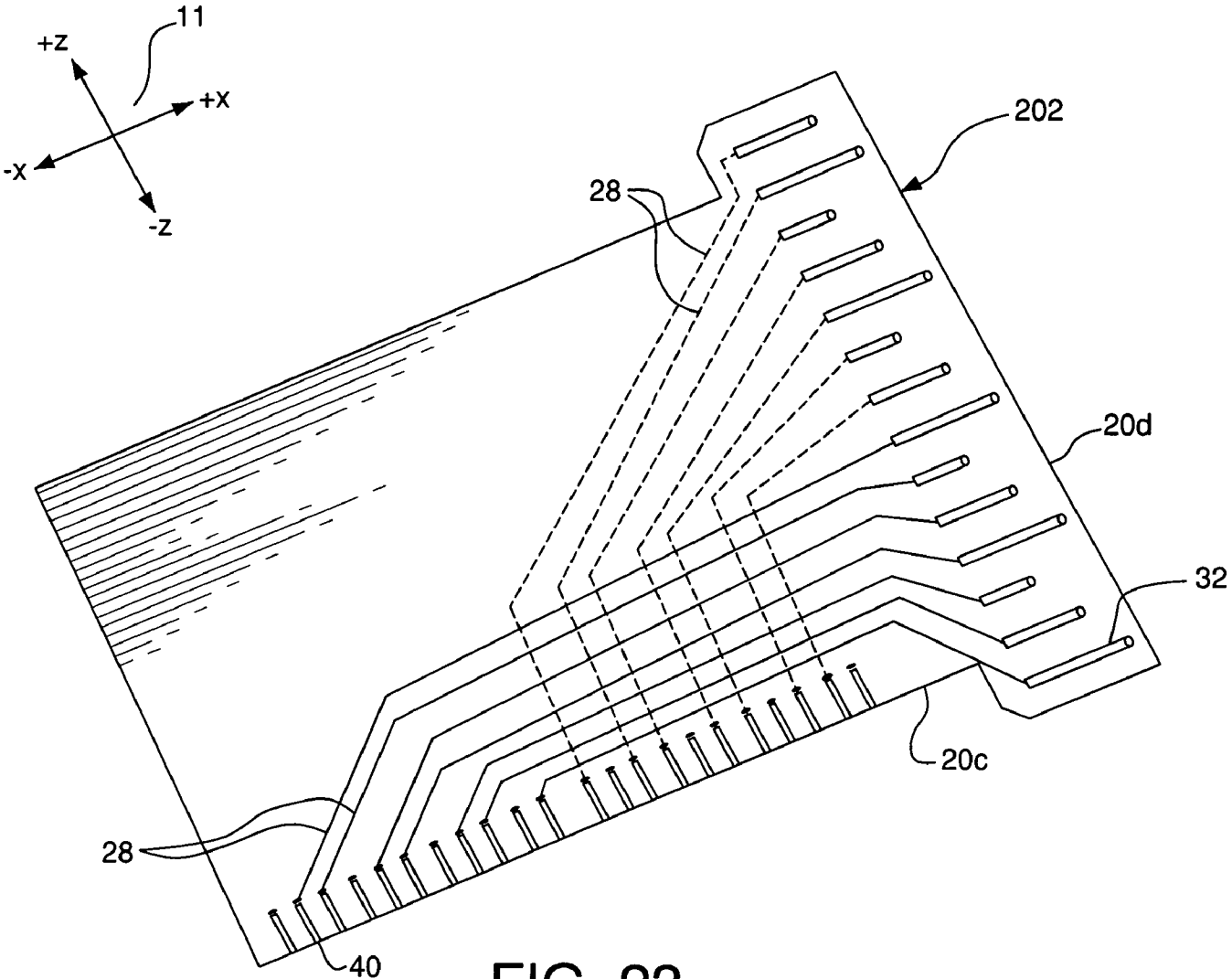
FIG. 23 is a diagrammatic side view of another alternative embodiment of the printed circuit board shown in FIGS. 6A–6D.

The maximum skew of the signal traces 28 can be reduced by routing the signal traces 28 on both of the first and second side surfaces 20*e*, 20*f* of the PCBs 20. This feature can facilitate the use of crossovers that permit the signal traces 28 coupled to the rear-most contacts 46, i.e., the contacts 46 located distant the forward edge 20*d*, to be routed to the lower-most contact fingers 32, i.e., the contact fingers 32 located proximate the lower edge 20*c*. Cross-talk between the signal traces 28 at the crossover point can be minimized by routing the signal traces 28 perpendicularly at the cross-over point (see FIG. 23, which depicts a PCB 202 with signal traces 28 arranged in this manner). This feature can also be applied to the signal traces 58 of the receptacle 14.

Figure 24A:
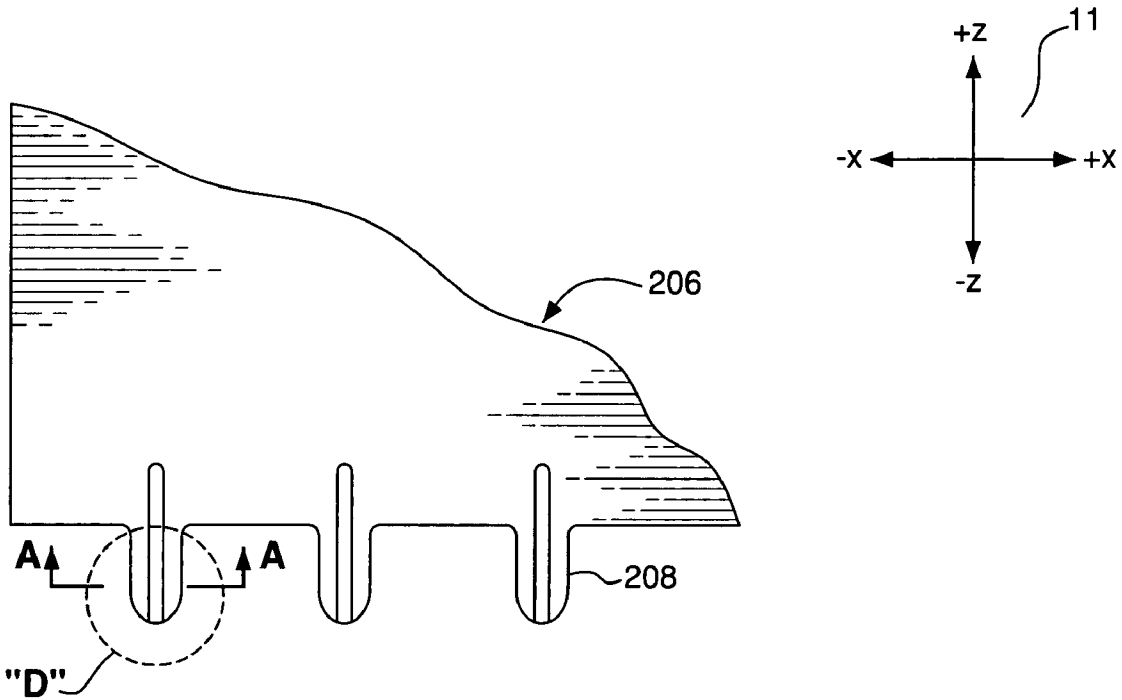
FIG. 24A is a diagrammatic side view of a portion of another alternative embodiment of the printed circuit board shown in FIGS. 6A–6D.
Figure 24B:
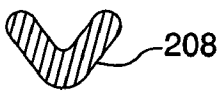
FIG. 24B is a magnified cross-sectional view of the area designated "D" in FIG. 23A.

FIGS. 24A and 24B depict another alternative embodiment of the PCBs 20 in the form of a PCB 206 having projections 208 that project from a lower edge thereof. The projections can be press fit into holes formed in a corresponding alternative embodiment of the first daughter card 16. (The PCB 206 is otherwise substantially identical to the PCB 20). The projections can help to secure the PCB 206 to the alterative embodiments of the first or second daughter cards. (Alternative embodiments of the PCBs 50 can be equipped with similar features.)

Figure 25B:
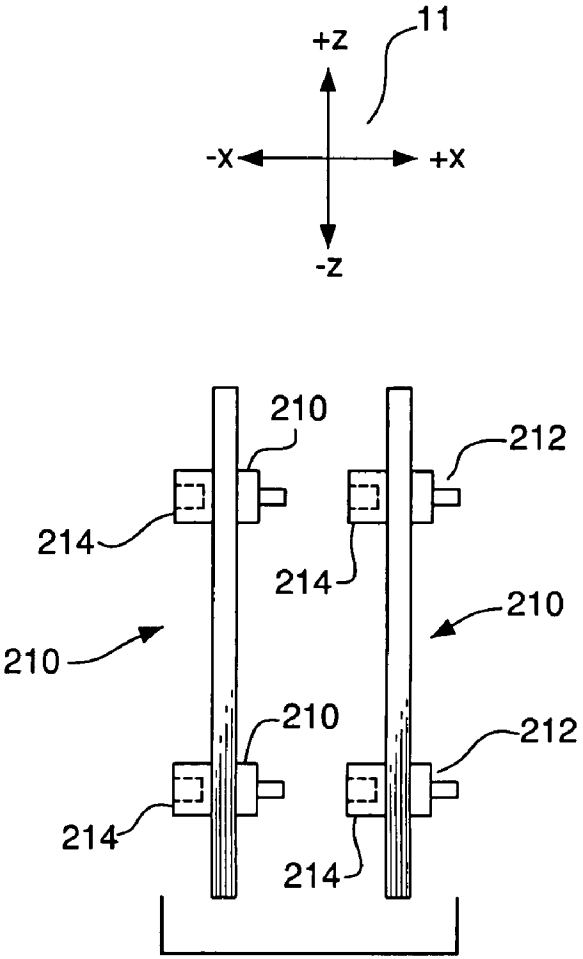
FIG. 25B is a front view of two of the PCBs shown in FIG. 25A, in an un-mated condition.
Figure 25A:
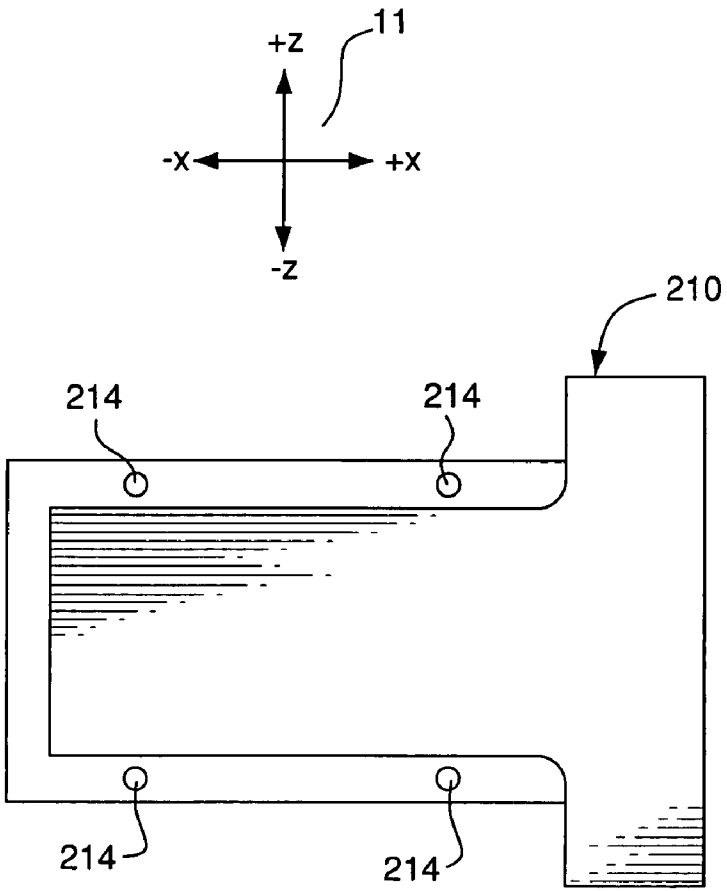
FIG. 25A is a diagrammatic side view of a portion of another alternative embodiment of the printed circuit board shown in FIGS. 6A–6D.

FIGS. 25A and 25B depict another alternative embodiment of the PCBs 20 in the form of a PCB 210 having projections 212 and complementary receptacles 214 formed thereon. The projections 212 and receptacles 214 can permit the PCB 210 to be stacked with and keyed to other ones of the PCBs 210. (Alternative embodiments of the PCBs 50 can be equipped with similar features.)

Other alternative embodiments of the PCBs 20 and PCBs 50 can include surface mount pads (not shown) plated directly to the edges lower edges 20*c*, 50*c* of the respective PCBs 20 and PCBs 50.

Figure 17:
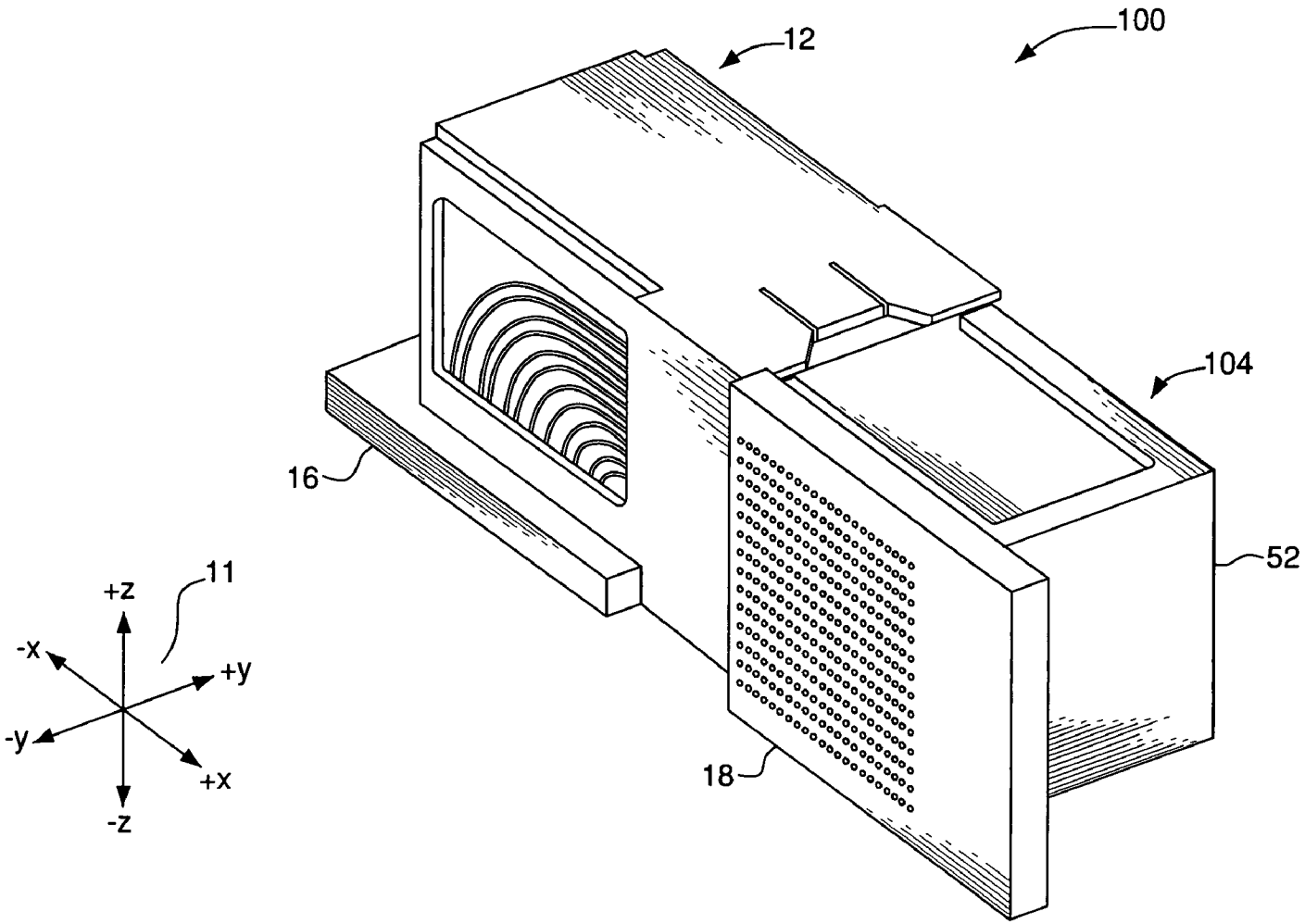
FIG. 17 is a top perspective view of an alternative embodiment of the modular electrical connector shown in FIG. 1, with a plug and a receptacle of the alternative embodiment in a mated condition and mounted respectively on the first and second daughter cards.

An alternative electrical connector 100 is depicted in FIGS. 17–21. The electrical connector 100 comprises the plug 12 as described above with respect to the electrical connector 10, and a receptacle 104. The plug 12 and the receptacle 104 can be mounted on the respective first and second daughter cards 16, 18 described above with respect to the electrical connector 10. The plug 12 and the receptacle 104 are can mate when the first and second daughter cards 16, 18 are positioned orthogonally, i.e., when the respective major planes of the first and second daughter cards 16, 18 are substantially perpendicular, as depicted in FIG. 17.

A detailed description of the receptacle 104 follows. Components of the receptacle 104 that are substantially identical to those of the receptacle 14 are denoted by identical reference numerals.

The receptacle 104 comprises the rear housing 52 and a plurality of the PCBs 50 mounted in the rear housing 52, as described above with respect to the receptacle 14. The receptacle 104 also comprises a front housing 102, details of which are presented below.

The receptacle comprises a plurality of the contacts 80. The contacts 80 electrically and mechanically couple the PCBs 50 to the daughter card 18, in a manner substantially identical to that described above in connection with the receptacle 14.

Figure 19:
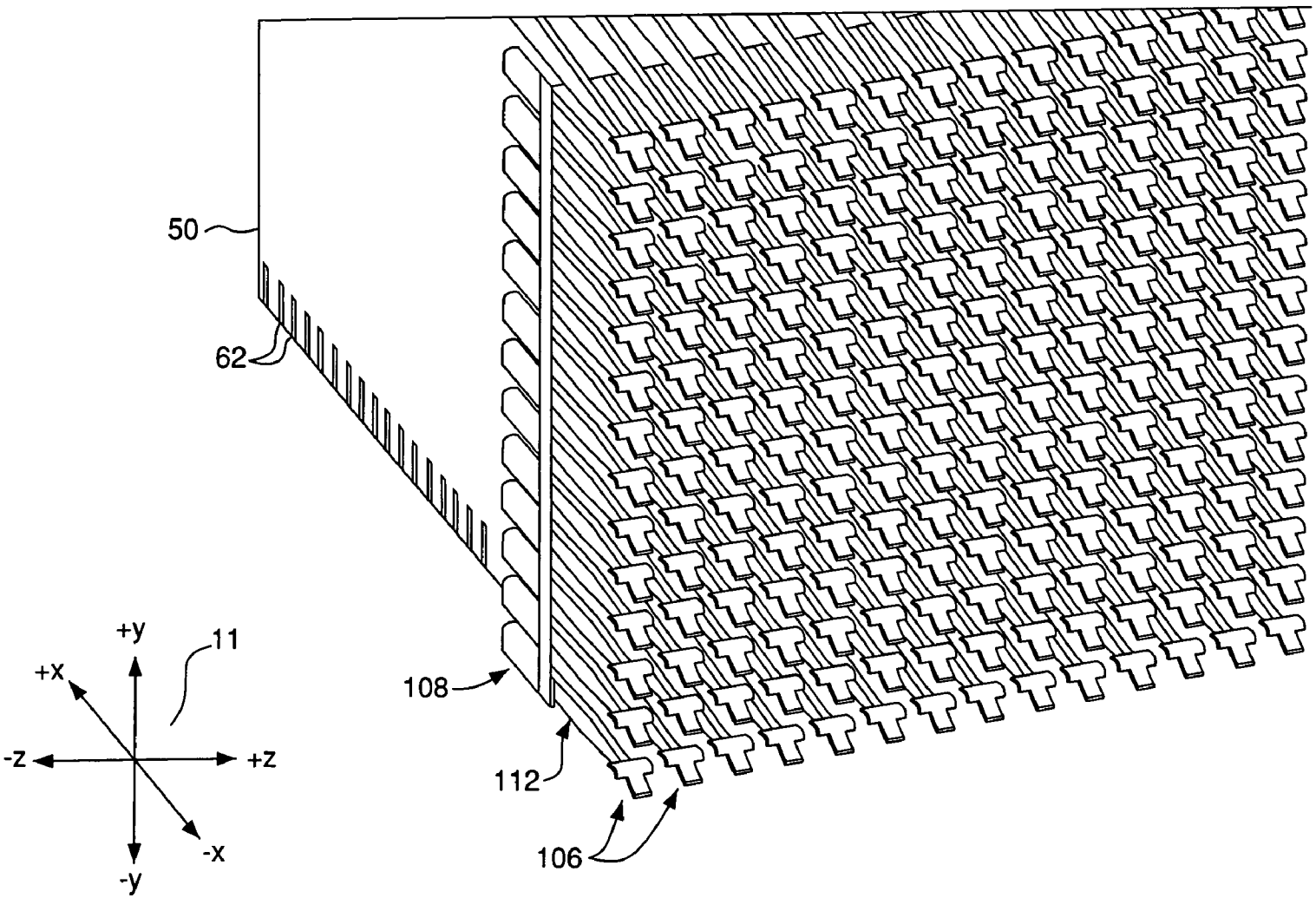
FIG. 19 is a top perspective view of the receptacle shown in FIGS. 17 and 18 with a front and rear cover of the receptacle removed and showing printed circuit boards, ground combs, and signal contacts of the receptacle.
Figure 20:
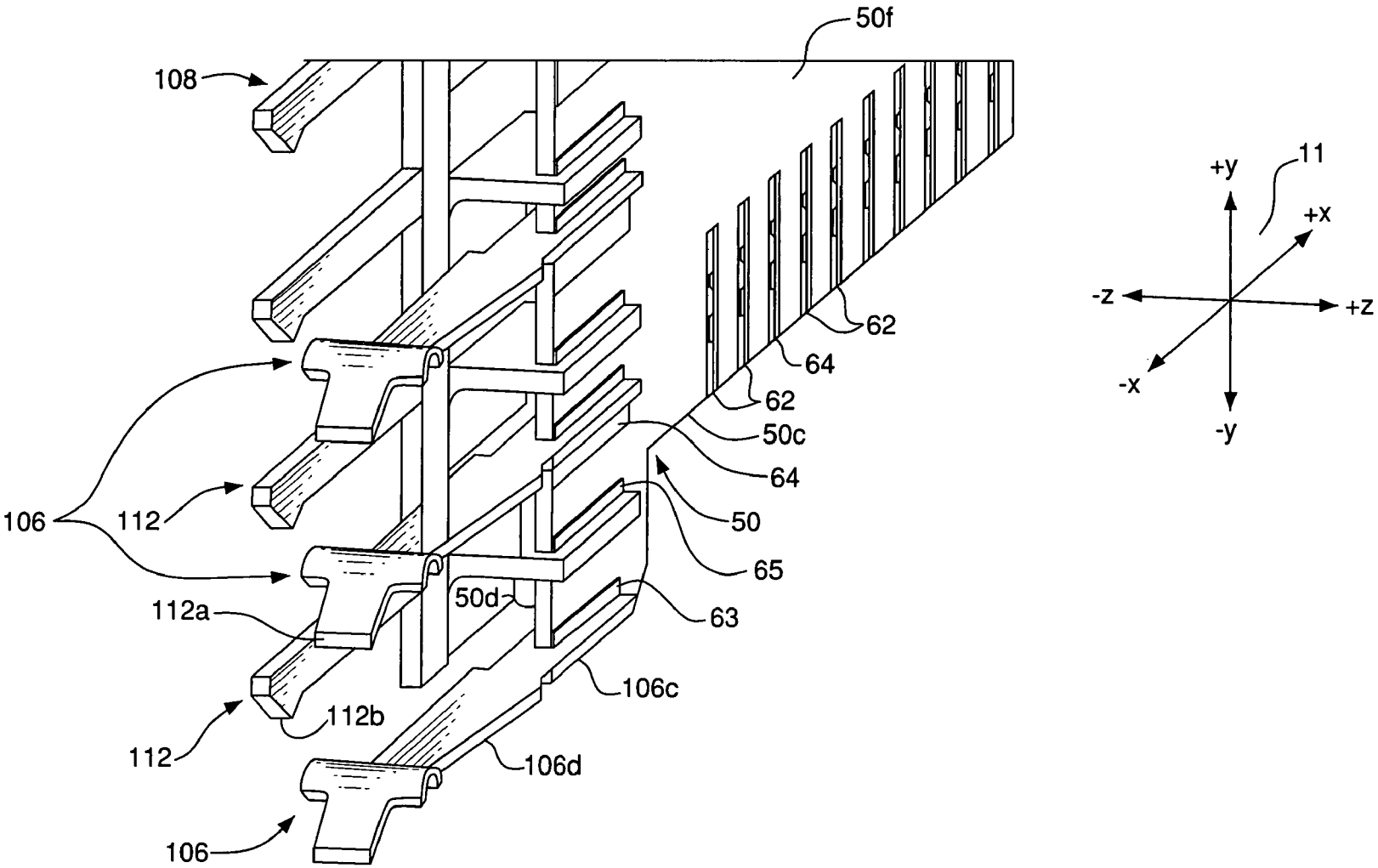
FIG. 20 is a top perspective view of one of the printed circuit boards, one of the ground combs, and one of the signal contacts shown in FIG. 19.
Figure 21:
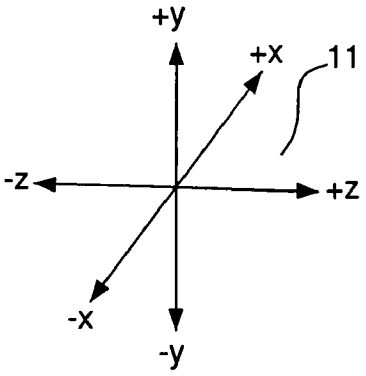
FIG. 21 is a top perspective view of the ground comb and signal contact shown in FIG. 20.
Figure 21:
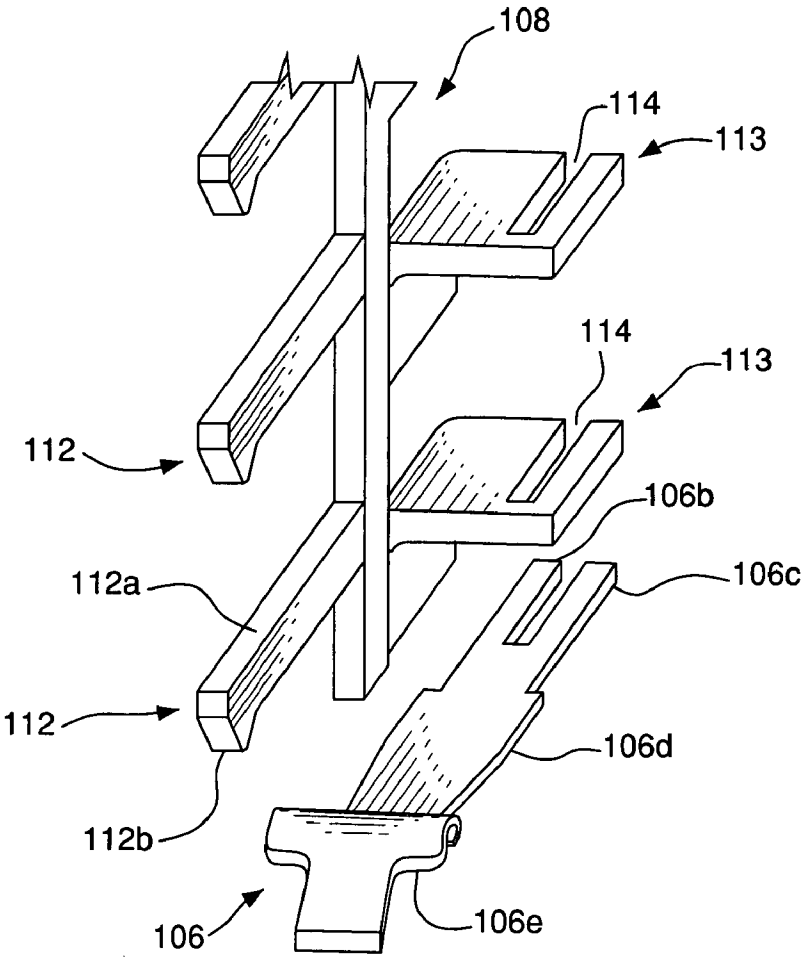

A plurality of signal contacts 106 are mounted on each PCB 50, proximate the forward edge 50*d* (see FIGS. 19–21). Each signal contact 106 has an end portion 106*a* comprising a first arm 106*b*, and a second arm 106*c* spaced apart from the first arm 106*b*.

Each signal contact 106 also comprises an elongated beam portion 106*d* and a substantially rounded contact portion 106*e*. The beam portion 106*d* and the contact portion 106*e* are substantially identical to the beam portions 66*d* and the contact portions 66*e* of the signal contacts 66.

The beam portion 106*d* is unitarily formed with and extends from the first and second arms 106*b*, 106*c*. The contact portion 106*e* is unitarily formed with the beam portion 106*d*, and is positioned at an end of the beam portion 106*d* opposite the first and second arms 106*b*, 106*c*. The contact portion 106*e* is has a width (z-axis dimension) that is substantially greater than a width (z-axis dimension) of the beam portion 106*c*.

The first and second arms 106*b*, 106*c* of each signal contact 106 engage a corresponding PCB 50 proximate the forward edge 50*d* thereof. More particularly, the first and second arms 106*b*, 106*c* of each signal contact 106 are spaced apart so that insertion of the forward edge 50*d* between the first and second arms 106*b*, 106*c* causes the first and second arms 106*b*, 106*c* to resiliently flex away from each other. Continued insertion of the forward edge 50*d* into the space between the first and second arms 106*b*, 106*c*, in combination with the resilience of the first and second arms 106*b*, 106*c*, causes the first and second arms 106*b*, 106*c* to securely engage the respective sides 50*e*, 50*f* of the PCB 50. In other words, the end portion 106*a* of each signal contact 106 acts substantially as a tuning-fork-type contact.

The first arms 106*b* of each signal contact 66 contact a respective one of the second signal pads 63 on the surface 50*e*, thereby establishing electrical contact between the signal contact 106 and the corresponding signal trace 58.

The receptacle 104 further comprises a plurality of ground combs 108 (see FIGS. 19–21). Each ground comb 108 comprises a mounting portion 110 and a plurality of ground contacts 112 unitarily formed with the mounting portion 110. Each ground contact 112 comprises a beam portion 112*a* that adjoins and extends from the mounting portion 110. Each ground contact 112 further comprises a contact portion 112*b* unitarily formed with the beam portion 112*a*, and positioned at an end of the beam portion 112*a* opposite the mounting portion 110. The beam portion 112*a* and the contact portion 112*b* are substantially identical to the respective beam portions 72*a* and the contact portion 72*b* of the ground contacts 72.

The ground comb 108 is mounted in a substantially parallel orientation with respect to the PCBs 50. The ground comb 108 comprises a plurality of mounting tabs 113 each having a slot 114 formed therein. The mounting portion 110 securely engages the PCBs 50 by way of the slots 114. More particularly, each slot 114 has a width (z-axis dimension) approximately equal to or slightly smaller than a width of the PCB 50. The slots 114 each receive the forward edge 50*d* of each PCB 50. Continued insertion of the forward edge 50*d* into the slot 114, in conjunction with the resulting interference between the PCB 50 and the edges of the slot 114, cause the PCB 50 to securely engage the corresponding mounting tab 113.

The mounting tabs 113 each contact a corresponding pair of the second ground pads 65 on the PCBs 50, thereby establishing electrical contact between the corresponding ground plane 60 and the mounting portion 110 (as well as the ground contacts 112). The respective locations of the second ground pads 65 and the second signal pads 63 on each PCB 50 are staggered so that the mounting portion 110 contacts only the second ground pads 65, and the signal contacts 106 contact only the second signal pads 63.

The ground combs 108 and the signal contacts 106 are positioned so that each signal contact 106 is positioned proximate a corresponding one of the ground contacts 112, as depicted in FIG. 20. More particularly, each signal contact 106 is faces a corresponding one of the ground contacts 112, and the contact portion 106*e* of the signal contact 106 is spaced apart from the corresponding contact portion 112*b* of the ground contact with respect to the "y" direction depicted in the figures.

FIG. 19 depicts the receptacle 104 without the front and rear housings 102, 52 installed, and thus shows the full array of signal contacts 106 and ground contacts 112 mated with the PCBs 50.

The front housing 102 substantially covers the signal contacts 106 and the ground contacts 72. The front housing 102 has a plurality of slots 106 formed therein (see FIG. 18). The slots 106 extend in a direction substantially parallel to the major plane of the daughter card 18, i.e., the slots 106 extend in a direction substantially perpendicular to the PCBs 50. The slots 106 facilitate access to the signal contacts 106 and the ground contacts 112.

Figure 18:
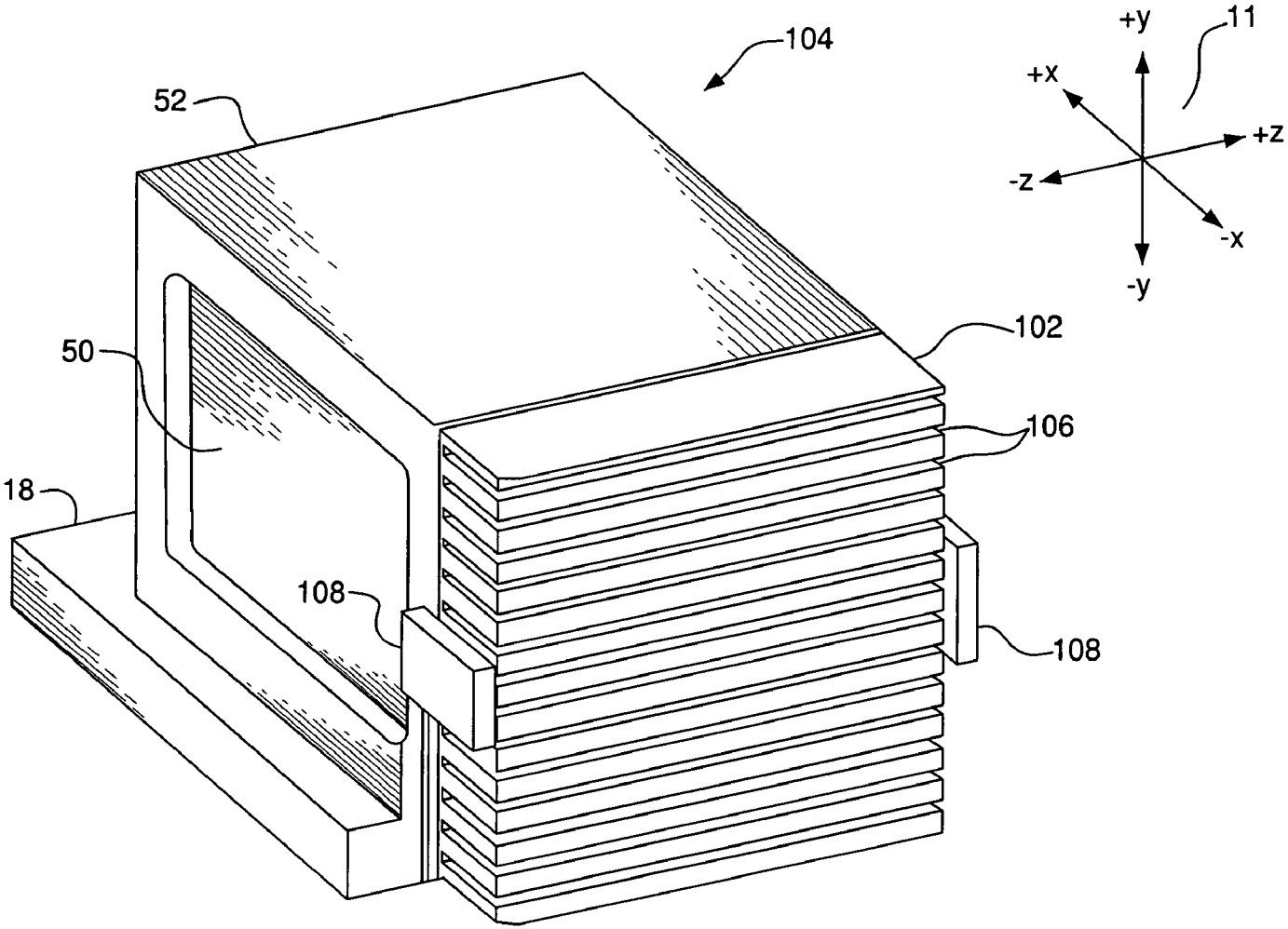
FIG. 18 is a top perspective view of the receptacle and the second daughter card shown in FIG. 17.

The front housing 102 has a first and a second key 108 formed respectively on a first and second side surface thereof, as depicted in FIG. 18. The first and second keys 108 engage the housing 22 of the plug 12 by way of the slots 23 when the plug 12 and the receptacle 104 are mated. The front housing 102 is secured to the rear housing 52 by an interference fit between the front housing 102, the rear housing 52, and the signal and ground contacts 106, 112.

The plug 12 and the receptacle 104 can mate when the first and second daughter cards 16, 18 are positioned orthogonally, as noted above. The signal contacts 106 contact the contact fingers 32 of the PCBs 20 when the plug 12 and the receptacle 14 are mated, in a manner substantially identical manner to that described above with respect to the plug 12 and the receptacle 14. The ground contacts 112 likewise contact the contact regions 44 of the PCBs 20 when the plug 12 and the receptacle 14 are mated, in a manner substantially identical manner to that described above with respect to the plug 12 and the receptacle 14.

Moreover, the above-noted features that facilitate relative movement between the plug 12 and the receptacle 14 are incorporated into the receptacle 104, and likewise facilitate relative movement between the plug 12 and the receptacle 104. For example, a clearance of approximately 0.5 mm exists between the upper lip 22*b* and the adjacent surface of the front housing 54, and between the lower lip 22*c* and the adjacent surface of the front housing 54 when the plug 12 and the receptacle 14 are mated and in substantial alignment.

What is claimed is:

1. A modular electrical connector, comprising:

a plug comprising a printed circuit board and a housing for supporting and constraining the printed circuit board so that a portion of the printed circuit board extends from the housing in a first direction, the printed circuit board having a flexible portion, the flexible portion being thinner than a remainder of the printed circuit board and having a first and a second substantially planar surface so that the portion of the printed circuit board can translate in a second direction in relation to the housing, the second direction being substantially perpendicular to the first direction.

2. The modular electrical connector of claim 1, further comprising a receptacle and a receptacle housing, wherein the receptacle housing has a first and a second key formed respectively on the first and second sides, the first and second lips have a respective first and second slot formed therein, and the first and second lips engage the respective first and second keys by way of the respective first and second slots when the plug and the receptacle are mated.

3. The modular electrical connector of claim 1, wherein: the plug can be mounted on an electrical component; and the plug further comprises a tuning-fork-type contact comprising a first arm, a second arm spaced apart from the first arm, and a pin portion adjoining the first and second arms, the first and second arms contacting opposing sides of the printed circuit board and the pin portion securely engaging the electrical component when the plug is mounted on the electrical component.

4. The modular electrical connector of claim 1, wherein: the printed circuit board of the plug has a first plurality of conductive traces formed thereon, the first plurality of conductive traces extending between a first and a substantially perpendicular second edge of the printed circuit board of the plug.

5. The modular electrical connector of claim 1, wherein a forward portion of the printed circuit board is substantially contoured.

6. The modular electrical connector of claim 1, wherein a forward edge of the printed circuit board is stepped so that a length of an uppermost portion of the printed circuit board is greater than a length of a lowermost portion of the printed circuit board.

7. The modular electrical connector of claim 1, wherein the printed circuit board has an electrically-conductive trace formed thereon and extending along a first and an opposing second surface of the printed circuit board.

8. The modular electrical connector of claim 1, wherein the plug comprises a plurality of first contacts, a plurality of second contacts mechanically coupled to a lower edge of the printed circuit board, and a plurality of electrically-conductive traces each extending between one of the plurality of the first contacts and a respective one of the plurality of second contacts, and the one of the electrically-conductive traces coupled to the one of the first contacts most proximate the lower edge extends to the one of the second contacts most distant from a forward edge of the printed circuit board.

9. The modular electrical connector of claim 1, wherein the printed circuit board has a rib extending from an upper edge thereof, and the housing of the plug has a slot formed in an upper inner surface thereof for receiving the rib.

10. The modular electrical connector of claim 1, further comprising a contact mounted on a first side of the printed circuit board, wherein the contact comprises a substantially U-shaped staple.

11. The modular electrical connector of claim 10, wherein the staple has an elongated portion and a first and a second leg adjoining the elongated portion, and the first and the second leg can be mounted on a surface of the printed circuit board so that the elongated portion is spaced apart from the surface.

12. The modular electrical connector of claim 1, wherein the plug comprises a plurality of the printed circuit boards, and a plate mechanically coupled to forward portions of the plurality of the printed circuit boards.

13. The modular electrical connector of claim 12, wherein the plug comprises a first and a second of the plates mechanically coupled to respective upper and lower edges of the forward portions of the plurality of printed circuit boards.

14. The modular electrical connector of claim 1, further comprising a contact, wherein the contact is mounted on a first side of the printed circuit board and the plug further comprises a ground plate mounted on a second side of the printed circuit board of the plug.

15. The modular electrical connector of claim 14, wherein the ground plate is spaced apart from a second side of the printed circuit board.

16. The modular electrical connector of claim 14, wherein the contact is formed by screening dielectric material through a graduated mask to form a rounded contact region on the printed circuit board, and metalizing the contact region.

17. The modular electrical connector of claim 14, wherein the contact is formed by molding a raised area into the printed circuit board, and metalizing the raised area.

18. The modular electrical connector of claim 14, wherein the contact comprises one of round wire and a stamped conductor surface soldered and crimped to the printed circuit board.

19. The modular electrical connector of claim 1, further comprising a receptacle, wherein the receptacle comprises a first contact for electrically contacting the contact of the plug when the plug and the receptacle are mated, a second printed circuit board, and a ground comb comprising a ground contact and a mounting tab, the ground comb extending substantially parallel to the second printed circuit board and securely engaging the second printed circuit board by way of a slot formed in the mounting tab.

20. The modular electrical connector of claim 19, wherein the printed circuit board of the plug comprises a first and a second electrically-conductive trace formed on opposing sides of the printed circuit board, and the first contact and the ground contact electrically contact the respective first and second electrically-conductive traces when the plug and the receptacle are mated.

21. The modular electrical connector of claim 19, wherein the first contact is electrically and mechanically coupled to the second printed circuit board of the receptacle and comprises an angled portion, an elongated portion adjoining the angled portion, and a contact portion adjoining the elongated portion and being spaced apart from at least a portion of the ground contact so that the contact portion and the ground contact contact opposing sides of the printed circuit board of the plug.

22. The modular electrical connector of claim 21, wherein the contact portion and the ground contact are spaced apart in a direction substantially parallel to the second printed circuit board of the receptacle.

23. The modular electrical connector of claim 22, wherein the slot formed in the housing of the receptacle is substantially perpendicular to the second printed circuit board of the receptacle.

24. A modular electrical connector, comprising;

a plug comprising a first housing, a first printed circuit board at least partially mounted in the first housing so that a portion of the first printed circuit board extends from the first housing in a first direction and can flex in relation to the first housing in a second direction substantially perpendicular to the first direction, the portion of the first printed circuit board being thinner than a remainder of the first printed circuit board and having a first and a second substantially planar surface, and a contact mounted on the portion of the first printed circuit board; and a receptacle for mating with the plug and comprising a second printed circuit board, a contact mounted on the second printed circuit board for electrically contacting the contact of the plug when the plug and the receptacle are mated, and a second housing for substantially enclosing the contact of the receptacle, the second housing having a slot formed therein for receiving the portion of the printed circuit board and extending in a third direction substantially perpendicular to the first and second directions when the plug and the receptacle are mated.

25. The modular electrical connector of claim 24, wherein the slot extends between a first and a second side of the second housing, the first housing comprises a first and a second lip extending from the first housing substantially in the first direction, the second housing is positioned substantially between the first and second lips when the plug and the receptacle are mated, and a clearance exists between at least one of the first side of the second housing and the first lip, and the second side of the second housing and the second lip so that the plug is capable of a predetermined range of movement in relation to the receptacle substantially in the third direction.

26. The modular electrical connector of claim 25, wherein the contact of the receptacle comprises an elongated portion extending substantially in the first direction when the plug and the receptacle are mated, and a contact portion mechanically and electrically coupled to the elongated portion and extending substantially in the third direction for contacting the contact of the plug when the plug and the receptacle are mated.

27. A modular electrical connector, comprising:

a plug comprising a housing and a printed circuit board mounted in the housing so that an end portion of the printed circuit board extends from the housing in a second direction and overhangs an edge of the housing, the printed circuit board having a flexible portion formed therein that permits the end portion of the circuit board to deflect in a first direction in relation to the housing, the flexible portion of the printed circuit board being thinner than a remainder of the printed circuit board and having a first and a second substantially planar surface, wherein the second direction is substantially perpendicular to the first direction; and a receptacle for mating with the plug and comprising a housing having a slot formed therein for receiving the end portion so that misalignment between plug and the receptacle causes the end portion to flex in response to contact between the end portion and the housing of the receptacle.

28. A modular electrical connector, comprising:

a plug comprising a printed circuit board, a contact positioned on a portion of the printed circuit board, and a housing for supporting and constraining the printed circuit board so that the portion of the printed circuit board extends from the housing, the printed circuit board having a flexible portion that permits the portion of the printed circuit board to translate in relation to the housing; and a receptacle for mating with the plug and comprising: a first contact for electrically contacting the contact of the plug when the plug and the receptacle are mated; a housing having a slot formed therein for receiving the portion of the printed circuit board of the plug when the plug and the receptacle are mated; a printed circuit board; and a ground comb comprising a ground contact, the ground comb extending substantially perpendicular to the printed circuit board of the receptacle and securely engaging the printed circuit board of the receptacle by way of a slot formed in the ground comb.

29. The modular electrical connector of claim 28, wherein a first and a second electrically-conductive trace are formed on opposing sides of the printed circuit board of the plug, and the first contact and the ground contact electrically contact the respective first and second electrically-conductive traces when the plug and the receptacle are mated.

30. The modular electrical connector of claim 28, wherein the first contact is electrically and mechanically coupled to the printed circuit board of the receptacle and comprises an angled portion, an elongated portion adjoining the angled portion, and a contact portion adjoining the elongated portion and being spaced apart from at least a portion of the ground contact so that the contact portion and the ground contact opposing sides of the printed circuit board of the plug.

31. The modular electrical connector of claim 30, wherein the contact portion and the ground contact are spaced apart in a direction substantially perpendicular to the printed circuit board of the receptacle.

32. The modular electrical connector of claim 31, wherein the slot formed in the housing of the receptacle is substantially parallel to the printed circuit board of the receptacle.

33. A modular electrical connector, comprising:

a plug comprising a printed circuit board, a contact positioned on a portion of the printed circuit board, and a housing for supporting and constraining the printed circuit board so that the portion of the printed circuit board extends from the housing, the printed circuit board having a flexible portion having a first and a second concave surface portion so that the flexible portion has an undulating shape that permits the portion of the printed circuit board to translate in relation to the housing; and a receptacle for mating with the plug and comprising a first contact for electrically contacting the contact of the plug when the plug and the receptacle are mated, and a housing having a slot formed therein for receiving the portion of the printed circuit board when the plug and the receptacle are mated.

* * * * *

UNITED STATES PATENT AND TRADEMARK OFFICE

CERTIFICATE OF CORRECTION

PATENT NO. : 7,059,907 B2
APPLICATION NO. : 10/626960
DATED : June 13, 2006
INVENTOR(S) : Winings et al.

It is certified that error appears in the above-identified patent and that said Letters Patent is hereby corrected as shown below:

Col. 9, line 30-31 and line 32, insert --and-- between "PCB50" and "the daughter card"

Col. 10, line 13, delete "meter" and substitute therefor --mated--

Col. 14, line 6, delete "is"

Col. 14, line 66, delete "is"

Col. 17, line 37, delete "contact contact" and substitute therefor --contact--

Signed and Sealed this

Fourteenth Day of November, 2006

JON W. DUDAS
*Director of the United States Patent and Trademark Office*

UNITED STATES PATENT AND TRADEMARK OFFICE

CERTIFICATE OF CORRECTION

PATENT NO. : 7,059,907 B2
APPLICATION NO. : 10/626960
DATED : June 13, 2006
INVENTOR(S) : Clifford Winings et al.

It is certified that error appears in the above-identified patent and that said Letters Patent is hereby corrected as shown below:

COL. 15, line 61 [claim 2] after "respectively on" delete "the"; after "second sides" insert --thereof--; before second occurrence of "first" delete "the" and substitute therefor --and--

COL. 15, line 62, delete "have a" and substitute therefor --having--; delete "slot" and substitute therefor --slots--

COL. 15, line 63, after "therein, and" insert --wherein--

COL. 17, line 45 [claim 23], delete "housing of the receptacle" and substitute therefor --mounting tab--

COL. 17, line 48 [claim 24], delete "comprising;" and substitute therefor --comprising:-- [delete semi-colon and substitute colon therefor]

COL. 18, line 39, [claim 27], after "between" and before "plug" insert --the--

COL. 19, line 10, [claim 30], after "contact" and before "opposing" insert a second --contact-- so that lines 9-10 read "the contact portion and the ground contact contact opposing sides"

Signed and Sealed this

Twenty-fourth Day of February, 2009

John Doll

JOHN DOLL
*Acting Director of the United States Patent and Trademark Office*